US007136034B2

(12) United States Patent
Tokunaga et al.

(10) Patent No.: US 7,136,034 B2
(45) Date of Patent: Nov. 14, 2006

(54) METHOD OF DRIVING A DISPLAY PANEL

(75) Inventors: Tsutomu Tokunaga, Yamanashi-ken (JP); Nobuhiko Saegusa, Yamanashi-ken (JP); Kazuo Yahagi, Yamanashi-ken (JP); Mitsushi Kitagawa, Fukuroi (JP); Shigeru Iwaoka, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 597 days.

(21) Appl. No.: 10/678,276

(22) Filed: Oct. 6, 2003

(65) Prior Publication Data

US 2004/0066394 A1 Apr. 8, 2004

(30) Foreign Application Priority Data

Oct. 8, 2002 (JP) ..... 2002-295328

(51) Int. Cl.
*G09G 3/28* (2006.01)

(52) U.S. Cl. ..... 345/60; 345/66; 345/690

(58) Field of Classification Search ..... 345/60–67, 345/204, 690; 315/169.1–169.4; 313/582, 313/584–587

See application file for complete search history.

(56) References Cited

U.S. PATENT DOCUMENTS

| | | | | |
|---|---|---|---|---|
| 6,097,149 | A * | 8/2000 | Miyaji et al. | 313/582 |
| 6,621,231 | B1 * | 9/2003 | Kwon | 315/169.4 |
| 6,703,782 | B1 * | 3/2004 | Otani et al. | 313/585 |
| 7,075,504 | B1 * | 7/2006 | Tokunaga et al. | 345/66 |
| 2002/0158821 | A1 * | 10/2002 | Lim | 345/60 |

FOREIGN PATENT DOCUMENTS

| | | |
|---|---|---|
| JP | 2001-154630 | 6/2001 |

* cited by examiner

*Primary Examiner*—Regina Liang
(74) *Attorney, Agent, or Firm*—Sughrue Mion, PLLC

(57) ABSTRACT

A display panel includes a plurality of unit light emission areas (light emission elements) arranged in a matrix. Each unit light emission area is defined by a first discharge cell and a second discharge cell. The second discharge cell has a light-absorbing layer. When the display panel is driven to express an image having a plurality of gradation levels, address discharge is selectively caused in the second discharge cells in accordance with an input image signal. Light leaks to the first discharge cell from the second discharge cell upon the address discharge. This light is used to express the gradation of low luminance. Since luminance difference between gradation levels of a low luminance image is reduced, it is possible to display a high quality, low luminance image.

19 Claims, 14 Drawing Sheets

FIG. 2
PRIOR ART

● : SELECTED LIGHT - EXTINCTION DISCHARGE
○: LIGHT EMITTING SUBFIELD

| GRADATION LEVELS | CONVERSION TABLE | | | | | | | | | | | | | LIGHT EMISSION DRIVING PATTERN | | | | | | | | | | | | DISPLAY LUMINANCE |
|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 | |
| 1 | 0000 | 1 | 0 | 0 | 0 | 0 | 0 | 0 | 0 | 0 | 0 | 0 | 0 | ● | | | | | | | | | | | | 0 |
| 2 | 0001 | 0 | 1 | 0 | 0 | 0 | 0 | 0 | 0 | 0 | 0 | 0 | 0 | ○ | ● | | | | | | | | | | | 1 |
| 3 | 0010 | 0 | 0 | 1 | 0 | 0 | 0 | 0 | 0 | 0 | 0 | 0 | 0 | ○ | ○ | ● | | | | | | | | | | 3 |
| 4 | 0011 | 0 | 0 | 0 | 1 | 0 | 0 | 0 | 0 | 0 | 0 | 0 | 0 | ○ | ○ | ○ | ● | | | | | | | | | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 14 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 25 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 39 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 59 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 84 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 117 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 157 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 205 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 |

FIG. 9

| GRADATION DRIVE | CONVERSION TABLE | | | | | | | | | | | | | | | | | LIGHT EMITTING PATTERN | | | | | | | | | | | | | | |
|---|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | 15 | | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 |
| 1ST | 0000 | 0 | * | * | * | * | * | * | * | * | * | * | * | * | * | * | | | | | | | | | | | | | | | | |
| 2ND | 0001 | 1 | 1 | * | * | * | * | * | * | * | * | * | * | * | * | * | | ◎ | ● | | | | | | | | | | | | | |
| 3RD | 0010 | 1 | 0 | 1 | * | * | * | * | * | * | * | * | * | * | * | * | | ◎ | ○ | ● | | | | | | | | | | | | |
| 4TH | 0011 | 1 | 0 | 0 | 1 | * | * | * | * | * | * | * | * | * | * | * | | ◎ | ○ | ○ | ● | | | | | | | | | | | |
| 5TH | 0100 | 1 | 0 | 0 | 0 | 1 | * | * | * | * | * | * | * | * | * | * | | ◎ | ○ | ○ | ○ | ● | | | | | | | | | | |
| 6TH | 0101 | 1 | 0 | 0 | 0 | 0 | 1 | * | * | * | * | * | * | * | * | * | | ◎ | ○ | ○ | ○ | ○ | ● | | | | | | | | | |
| 7TH | 0110 | 1 | 0 | 0 | 0 | 0 | 0 | 1 | * | * | * | * | * | * | * | * | | ◎ | ○ | ○ | ○ | ○ | ○ | ● | | | | | | | | |
| 8TH | 0111 | 1 | 0 | 0 | 0 | 0 | 0 | 0 | 1 | * | * | * | * | * | * | * | | ◎ | ○ | ○ | ○ | ○ | ○ | ○ | ● | | | | | | | |
| 9TH | 1000 | 1 | 0 | 0 | 0 | 0 | 0 | 0 | 0 | 1 | * | * | * | * | * | * | | ◎ | ○ | ○ | ○ | ○ | ○ | ○ | ○ | ● | | | | | | |
| 10TH | 1001 | 1 | 0 | 0 | 0 | 0 | 0 | 0 | 0 | 0 | 1 | * | * | * | * | * | | ◎ | ○ | ○ | ○ | ○ | ○ | ○ | ○ | ○ | ● | | | | | |
| 11TH | 1010 | 1 | 0 | 0 | 0 | 0 | 0 | 0 | 0 | 0 | 0 | 1 | * | * | * | * | | ◎ | ○ | ○ | ○ | ○ | ○ | ○ | ○ | ○ | ○ | ● | | | | |
| 12TH | 1011 | 1 | 0 | 0 | 0 | 0 | 0 | 0 | 0 | 0 | 0 | 0 | 1 | * | * | * | | ◎ | ○ | ○ | ○ | ○ | ○ | ○ | ○ | ○ | ○ | ○ | ● | | | |
| 13TH | 1100 | 1 | 0 | 0 | 0 | 0 | 0 | 0 | 0 | 0 | 0 | 0 | 0 | 1 | * | * | | ◎ | ○ | ○ | ○ | ○ | ○ | ○ | ○ | ○ | ○ | ○ | ○ | ● | | |
| 14TH | 1101 | 1 | 0 | 0 | 0 | 0 | 0 | 0 | 0 | 0 | 0 | 0 | 0 | 0 | 1 | * | | ◎ | ○ | ○ | ○ | ○ | ○ | ○ | ○ | ○ | ○ | ○ | ○ | ○ | ● | |
| 15TH | 1110 | 1 | 0 | 0 | 0 | 0 | 0 | 0 | 0 | 0 | 0 | 0 | 0 | 0 | 0 | 1 | | ◎ | ○ | ○ | ○ | ○ | ○ | ○ | ○ | ○ | ○ | ○ | ○ | ○ | ○ | ● |
| 16TH | 1111 | 1 | 0 | 0 | 0 | 0 | 0 | 0 | 0 | 0 | 0 | 0 | 0 | 0 | 0 | 0 | | ◎ | ○ | ○ | ○ | ○ | ○ | ○ | ○ | ○ | ○ | ○ | ○ | ○ | ○ | ○ |

*: 0 OR 1

◎ : WRITE ADDRESS DISCHARGE
● : EXTINCTION ADDRESS DISCHARGE
○ : SUSTAINING DISCHARGE

METHOD OF DRIVING A DISPLAY PANEL

BACKGROUND OF THE INVENTION

1. Field of the Invention

The present invention relates to a method of driving a display panel including light-emitting elements arranged in a matrix.

2. Description of the Related Art

Recently, a plasma display panel (referred to as "PDP") in which a number of discharge cells are arranged in a matrix has drawn attention as a two-dimensional image display panel. The PDP is directly driven by a digital image signal and the number of gradation levels (the number of luminance levels, gradation sequence) expressable by the PDP is decided by the number of bits of each pixel data included in the digital image signal.

A subfield method is known as a gradation sequence display method for the PDP. The subfield method divides a display period of one field into a plurality of subfields, and drives each discharge cell for each subfield. Each subfield includes an address period for setting each pixel in a lighting mode or a light extinguishing mode in accordance with the image data (pixel data) and an illumination maintaining (sustaining) period for only lighting a pixel in the lighting mode for a period determined by weighting of the subfield concerned. In other words, whether or not a discharge cell should be illuminated within each subfield (address period) is decided for each subfield, and only the discharge cell in the lighting mode is illuminated for a period (i.e., an illumination sustaining period) allocated to this subfield. Accordingly, one field may include one or more subfields in an illumination state and one or more subfields in a light extinguishment (extinction) state. Therefore, an intermediate (gray) luminance is created or perceived for that one field in accordance with a sum of the illumination periods of all the subfields in that one field.

One conventional method of driving a PDP is disclosed in Japanese Patent Kokai (Laid-Open Publication) No. 2001-154630. FIG. 1 of the accompanying drawings illustrates a light emission driving format for the PDP taught by this Japanese Patent Kokai No. 2001-154630. One field of an image signal is divided into twelve subfields SF1 to SF12, and driving of the PDP is executed for each subfield. Basically, each subfield includes an address stage Wc and an illumination (light emission) sustaining stage Ic. The address stage Wc sets each discharge cell of the PDP in either a lighting mode (i.e., an operable mode) or a light extinguishing mode (i.e., a nonoperable mode) on the basis of the input image data. The illumination sustaining stage Ic illuminates only a discharge cell in the lighting mode for a period (number of times) in accordance with weighting of the subfield concerned. It should be noted that an all-reset stage Rc is executed to initialize all the discharge cells of the PDP to the lighting mode in only the first subfield SF1 at the front end of the field, and an elimination (light extinction) stage E is executed in only the last subfield SF12 at the rear end of the field.

FIG. 2 of the accompanying drawings shows the relationship among pixel drive data GD obtained by applying a conversion process (will be described) to the pixel data, gradation levels (gradation sequence) corresponding to the pixel drive data GD, and a light emission driving pattern of the discharge cells in accordance with the pixel drive data GD. A similar diagram can be found in the above mentioned Japanese Patent Kokai No. 2001-154630.

By sampling an image signal, for example, pixel data of 8 bits can be obtained. The pixel data then undergoes a multi-gradation (grayscale) process, so that multi-gradation image data (pixel data) $PD_S$ is generated, of which the bit number is reduced to 4 bits, while maintaining the present number of gradation levels. The multi-gradation image data $PD_S$ is converted into the pixel driving data GD including first to twelfth bits in accordance with the conversion table shown in FIG. 2. The first to twelfth bits correspond to the subfields SF1 to SF12, respectively.

FIG. 3 of the accompanying drawings illustrates application timing of various driving pulses to row electrodes and column electrodes of the PDP in accordance with the light emission driving format shown in FIG. 2. A similar diagram can be found in the above mentioned Japanese Patent Kokai No. 2001-154630. FIG. 3 shows the driving of the PDP by a selective light-extinction method (one reset-one selective light extinction address method).

First, in the all-reset stage $R_C$ of the subfield SF1, a reset pulse $RP_X$ having a negative polarity is applied to row electrodes $X_1$ to $X_n$. In parallel with application of such a reset pulse $RP_X$, a reset pulse $RP_Y$ having a positive polarity is applied to row electrodes $Y_1$ to $Y_n$. As a result of application of the reset pulses $RP_x$ and $RP_Y$, all discharge cells of the PDP are reset-discharged, so that a wall electric charge of a certain amount is equally formed within each of the discharge cells. All the discharge cells are therefore initialized into the lighting mode (illumination mode).

Next, at the address stage Wc of each subfield, a pixel data pulse DP having a voltage corresponding to a logic level of a pixel driving data bit DB (DB1 to DB12) is generated. The pixel driving data bits DB1 to DB12 correspond to the first to twelfth bits of the pixel driving data GD. For example, at the address stage $W_C$ of the subfield SF1, the pixel driving data bit DB1 is first converted to a pixel data pulse having a voltage corresponding to a logic level of the pixel driving data bit DB1. Then, a pixel datapulse group $DP1_1$ having m pixel data pulses for the first display line is prepared, a pixel data pulse group $DP1_2$ having m pixel data pulses for the second display line is prepared, . . . and a pixel data pulse group $DP1_n$ having m pixel data pulses for the nth display line is prepared. These pixel data pulse groups $DP1_1$ to $DP1_n$ are sequentially applied to the column electrodes D1 to Dm.

In the address stage Wc, a scan pulse SP with a negative polarity is sequentially applied to the row electrodes $Y_1$ to $Y_n$ at the same timing as the application timing of the pixel data pulse groups DP. As a result, discharge (selected light-extinction discharge) occurs only in those discharge cells which are located at crossings of row electrodes to which the scan pulse SP is applied and column electrodes to which the high voltage pixel data pulse is applied, and the wall electric charge remaining in these discharge cells is eliminated.

According to such selected light-extinction discharge, the selected discharge cells shift from the light emitting mode to the light extinguishing mode. On the other hand, other discharge cells, in which the selected light-extinction discharge does not occur, maintain the initial condition (i.e., the light emitting mode) because the discharge cells are initialized to the light emitting mode at the all-reset stage Rc.

At the illumination sustaining stage Ic of each subfield, as shown in FIG. 3, light emission sustaining pulses $IP_X$ and $IP_Y$ with a positive polarity are alternately applied to the row electrodes $X_1$ to $X_n$ and row electrodes $Y_1$ to $Y_n$. At the illumination sustaining stage Ic, the sustaining pulses IP are applied such that the numbers of the sustaining pulses IP applied to the subfields SF1 to SF12 have a predetermined ratio. For example, in the case shown in FIG. 1, the ratio of the application numbers of the light emission maintaining pulses IP for the subfields are as follows;

SF1:SF2:SF3:SF4:SF5:SF6:SF7:SF8:SF9:SF10:SF11:S12=1:2:4:7:11:14:20:25:33:40:48:50.

The discharge cells in which the wall electric charge remains, namely, the discharge cells set to the lighting mode at the address stage Wc only perform the illumination-sustaining-discharge upon application of the illumination-sustaining pulses $IP_X$ and $IP_Y$. Accordingly, each of the discharge cells set to the lighting mode maintains the light emitting condition (light emission sustaining discharge) for a period corresponding to the numbers of the discharging, which is allocated to the subfield concerned.

A light extinction (elimination) stage E is executed only in the subfield SF12 at the rear end of the field. At the light extinction stage E, a light extinction (elimination) pulse AP with a positive polarity is generated and applied to the column electrodes $D_1$ to $D_m$. In parallel with the application of the light extinction pulse AP, another light extinction pulse EP with a negative polarity is generated and applied to each of the row electrodes $Y_1$ to $Y_n$. The simultaneous application of the light extinction pulses AP and EP triggers the light extinction discharge within all the discharge cells in the PDP, so that the wall electric charges remaining in the discharge cells are all eliminated. As a result of such electric-charge-elimination discharge, all the discharge cells in the PDP are set to the light extinction mode.

In the above described driving method, the selected discharge for light extinguishment in the following manner takes place at a particular subfield; only discharge cells in the light emitting state in the immediately preceding subfield are selected for light extinguishing discharge in the address stage. Thus, if the N (e.g., twelve) subfields are sequentially lit from the front (first) subfield, N+1 (thirteen)-gradation-level display is created. By summing up the numbers of the light emission sustaining discharges in the subfields, the grayscale image having luminance in accordance with the input image signal is created.

Since a characteristic of a human vision has a logarithmic property, human eyes are sensitive to variations in the gradation sequence in a dark image. In the above described PDP driving method, the luminance difference between the first gradation level, which represents the lowest luminance 0, and the second gradation level, which represents the second lowest luminance, is given (determined) by the luminance of the light obtained from the light emission sustaining discharge. Since it is difficult to decrease the luminance of the discharge to a desired level, it is not possible to create intermediate luminance which faithfully represents the input image signal when a relatively dark image (low luminance image) is displayed.

SUMMARY OF THE INVENTION

An object of the present invention is to provide a display panel driving method that can create a better gradation sequence in a low luminance image.

According to one aspect of the present invention, there is provided an improved method of driving a display panel to display a multi-gradation-level image based on an input image signal. The display panel is driven for each of a plurality of subfields. These subfields define one field of the input image signal. The display panel includes a front substrate and a back substrate which face each other across a discharge space. The display panel also includes a plurality of row electrode pairs arranged on an inner surface of the front substrate. Each row electrode has a first portion and a second portion. The display panel also includes a plurality of column electrodes arranged on an inner surface of the back substrate such that the column electrodes extend perpendicularly to the row electrode pairs and define a plurality of crossing portions of the column electrodes and row electrode pairs. A plurality of light emission elements are formed at the crossing portions of the column electrodes and row electrode pairs. Each light emission element is defined by a first discharge cell and a second discharge cell. The first discharge cell has the first portion of one row electrode and the first portion of a mating row electrode in the same row electrode pair such that these two first portions face each other over a first discharge gap in the discharge space. The second discharge cell has the second portion of one electrode in the row electrode pair belonging to the mating first discharge cell, and the second portion of one electrode belonging to an adjacent row electrode pair such that these two second portions faces each other over a second discharge gap in the discharge space. The second discharge cell also has a light-absorbing layer formed on the front substrate side. Each subfield includes an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition or a light extinction condition. Wall charge exists in the second discharge cell if the second discharge cell is set to the light emission condition. Wall charge does not exist in the second discharge cell if the second discharge cell is set to the light extinction condition. Light leaking to the first discharge cell from the second discharge cell upon the address discharge is used to express low-luminance gradation.

According to a second aspect of the present invention, there is provided another improved method of driving a display panel to display a multi-gradation-level image based on an input image signal by driving the display panel for each of a plurality of subfields. These subfields defines one field of the input image signal. The display panel includes a front substrate and a back substrate which face each other across a discharge space. The display panel also includes a plurality of row electrode pairs arranged on an inner surface of the front substrate, and a plurality of column electrodes arranged on an inner surface of the back substrate. The column electrodes extend perpendicularly to the row electrode pairs and define a plurality of crossing portions of the column electrodes and row electrode pairs. A plurality of light emission elements are formed at the crossing portions of the column electrodes and row electrode pairs. Each light emission element is defined by a first discharge cell and a second discharge cell. The second discharge cell has a light-absorbing layer formed on the front substrate side. Each subfield includes an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition or a light extinction condition. Wall charge exists in the second discharge cell if the second discharge cell is set to the light emission condition, and no wall charge exists in the second discharge cell if the second discharge cell is set to the light extinction condition. Light leaking to the first discharge cell from the second discharge cell upon the address discharge is used to express low-luminance gradation.

According to a third aspect of the present invention, there is provided still another method of driving a display panel to display a multi-gradation-level image based on an input image signal by driving the display panel for each of a plurality of subfields. These subfields define one field of the input image signal. The display panel includes a front substrate and a back substrate which face each other across a discharge space, a plurality of row electrode pairs arranged on an inner surface of the front substrate, and a plurality of column electrodes arranged on an inner surface of the back substrate. The column electrodes extend perpendicularly to the row electrode pairs and define a plurality of crossing portions of the column electrodes and row electrode pairs. A plurality of light emission elements are formed at the crossing portions of the column electrodes and row electrode pairs. Each light emission element is defined by a first discharge cell and a second discharge cell. The second discharge cell has alight-absorbing layer formed on the front substrate side. Each subfield includes an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition or a light extinction condition. Wall charge exists in the second discharge cell if the second discharge cell is set to the light emission condition, and no wall charge exists in the second discharge cell if the second discharge cell is set to the light extinction condition. The subfield also includes a priming stage for applying a priming pulse to two electrodes in each row electrode pair so as to trigger priming discharge in only those second discharge cells which are set to the light emission condition. Light leaking to the first discharge cell from the second discharge cell upon at least one of the address discharge and the priming discharge is used to express low-luminance gradation.

BRIEF DESCRIPTION OF THE DRAWINGS

FIG. 2 illustrates pixel drive data obtained from a conventional pixel data conversion table, together with a light emission drive pattern based on the pixel drive data, and luminance;

FIG. 9 shows pixel drive data obtained from a pixel data conversion table of the PDP apparatus shown in FIG. 4, together with a light emission drive pattern based on the pixel drive data;

DETAILED DESCRIPTION OF THE INVENTION

Embodiments according to the present invention will be described with reference to the accompanying drawings.

Figure 1:
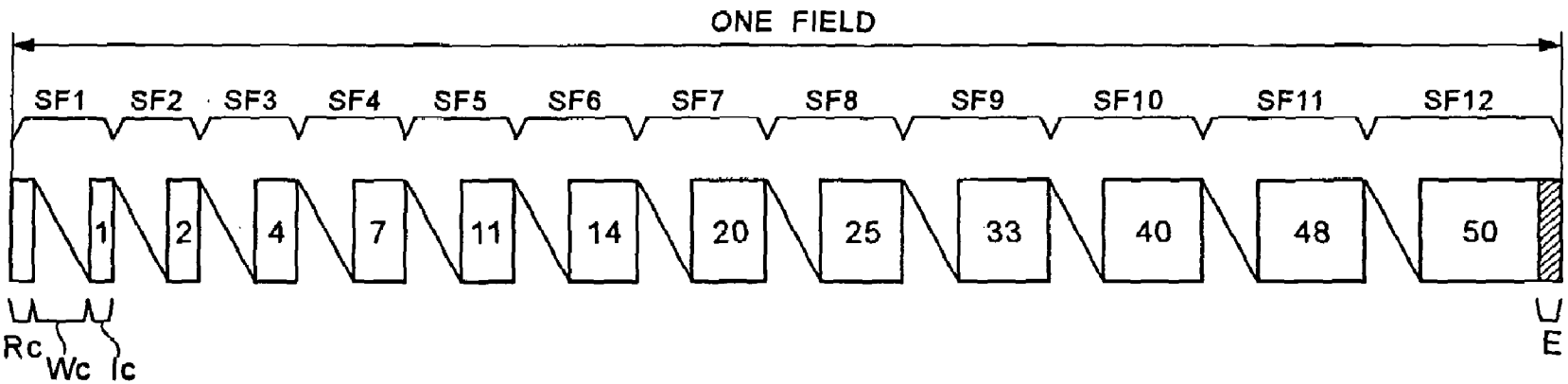
FIG. 1 PRIOR ART
FIG. 1 illustrates a typical example of a light emission drive format for a PDP according to a subfield method.
Figure 3:
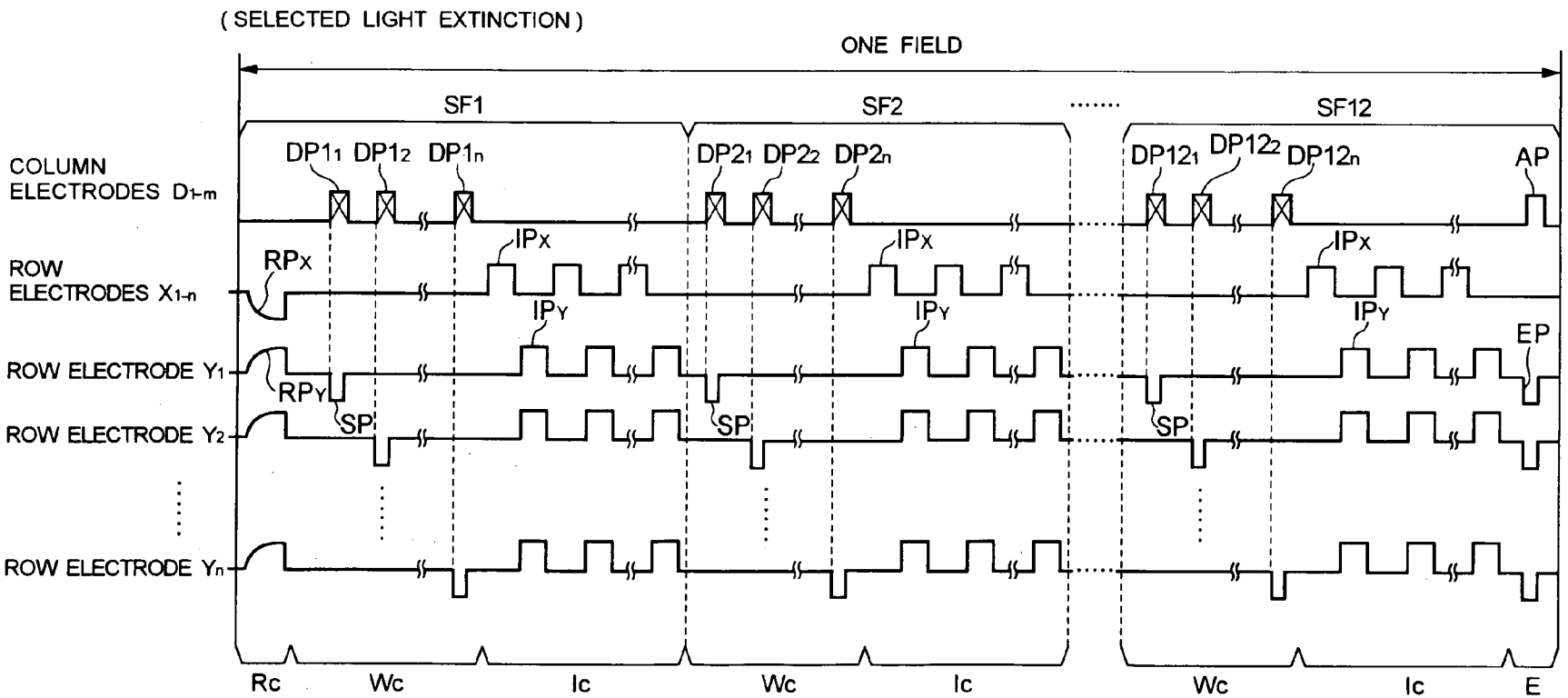
FIG. 3 PRIOR ART
FIG. 3 illustrates application timing of various drive pulses to row electrodes and column electrodes of the PDP in accordance with the light emission drive format shown in FIG. 1.
Figure 4:
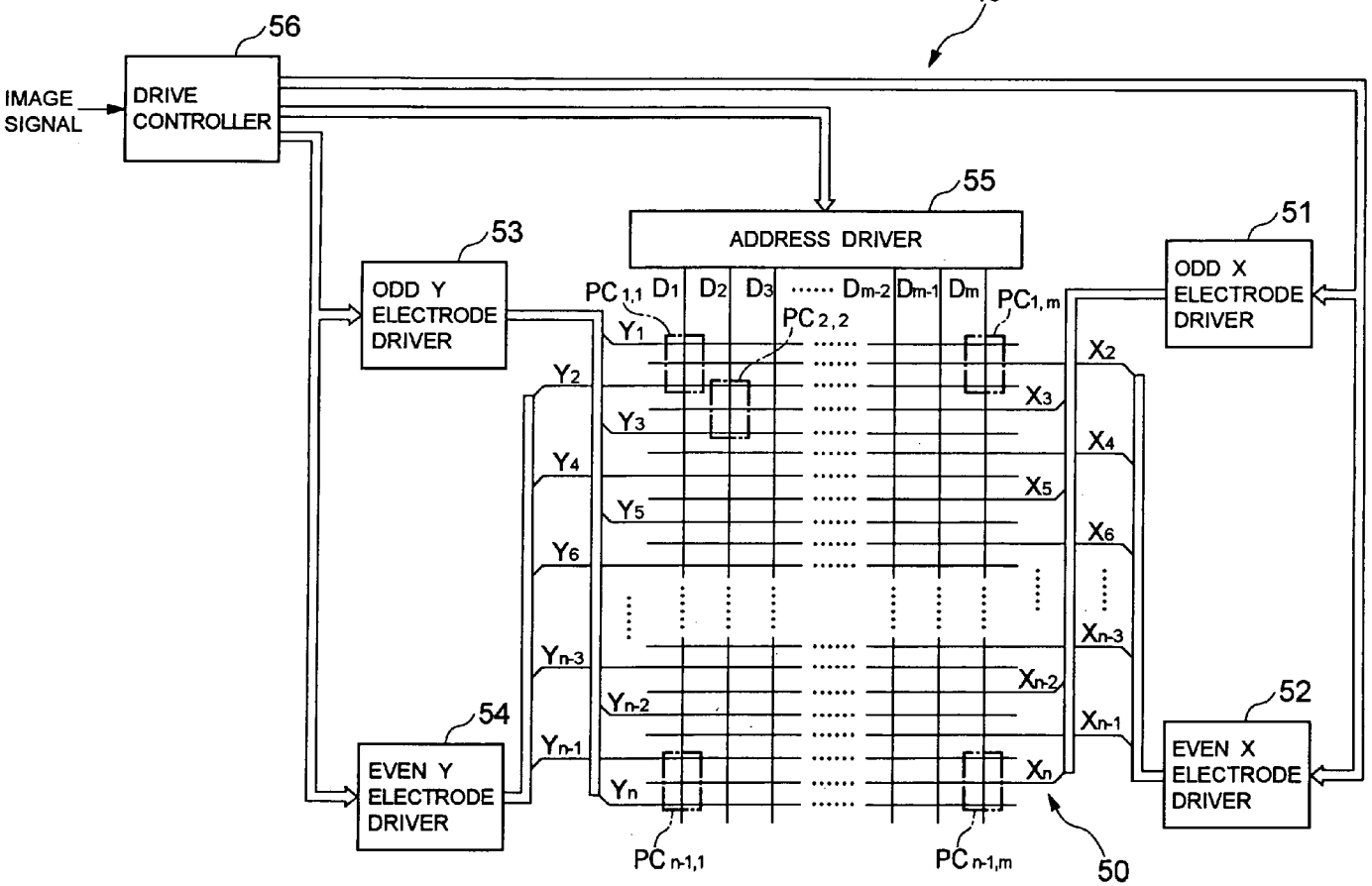
FIG. 4 PRIOR ART
FIG. 4 illustrates a schematic constitution of a PDP apparatus according to one embodiment of the present invention.

Referring first to FIG. 4, a block diagram of a display apparatus 49 according to a first embodiment of the present invention is illustrated.

The display apparatus 49 shown in FIG. 4 is a plasma display apparatus. The display apparatus 49 includes a plasma display panel (PDP) 50, an odd-number X electrode driver 51, an even-number X electrode driver 52, an odd-number Y electrode driver 53, an even-number Y electrode driver 54, an address driver 55 and a drive-control circuit 56.

The PDP 50 includes column electrodes $D_1$ to $D_m$, which extend in the vertical direction of the display panel. Each column electrode D has a strip shape. The PDP 50 also includes row electrodes $X_2$ to $X_n$ and row electrodes $Y_1$ to $Y_n$, which extend in the horizontal direction of the display panel. Each row electrode has a strip shape. The row electrodes are orthogonal to the column electrodes. The row electrodes $X_2$ to $X_n$ and the row electrodes $Y_1$ to $Y_n$ are arranged alternately. Each pair of row electrodes form one display line of the PDP 50. In the illustrated embodiment, each of the row electrode pairs $X_2$ and $Y_2$ to $X_n$ and $Y_n$ forms one display line of the PDP 50. In FIG. 4, the PDP 50 has the first display line to n-1th display line, which are defined by the row electrode pair $X_2$ and $Y_2$ to the row electrode pair $X_n$ and $Y_n$. At each crossing of the display lines and the column electrodes $D_1$ to $D_m$ (i.e., an area enclosed by the single-dash line in FIG. 4), a pixel cell PC is formed. Thus, the PDP 50 has the pixel cells arranged in a matrix. These pixel cells form pixels. In the PDP 50, the pixel cells $PC_{1,1}$ to $PC_{1,m}$ belong to the first display line, the pixel cells $PC_{2,1}$ to $PC_{2,m}$ belong to the second display line, . . . , and the pixel cells $PC_{n-1,1}$ to $PC_{n-1,m}$ belong to the n−1th display line. The pixel cell PC may be referred to as light emission element or unit area for light emission.

Figure 5:
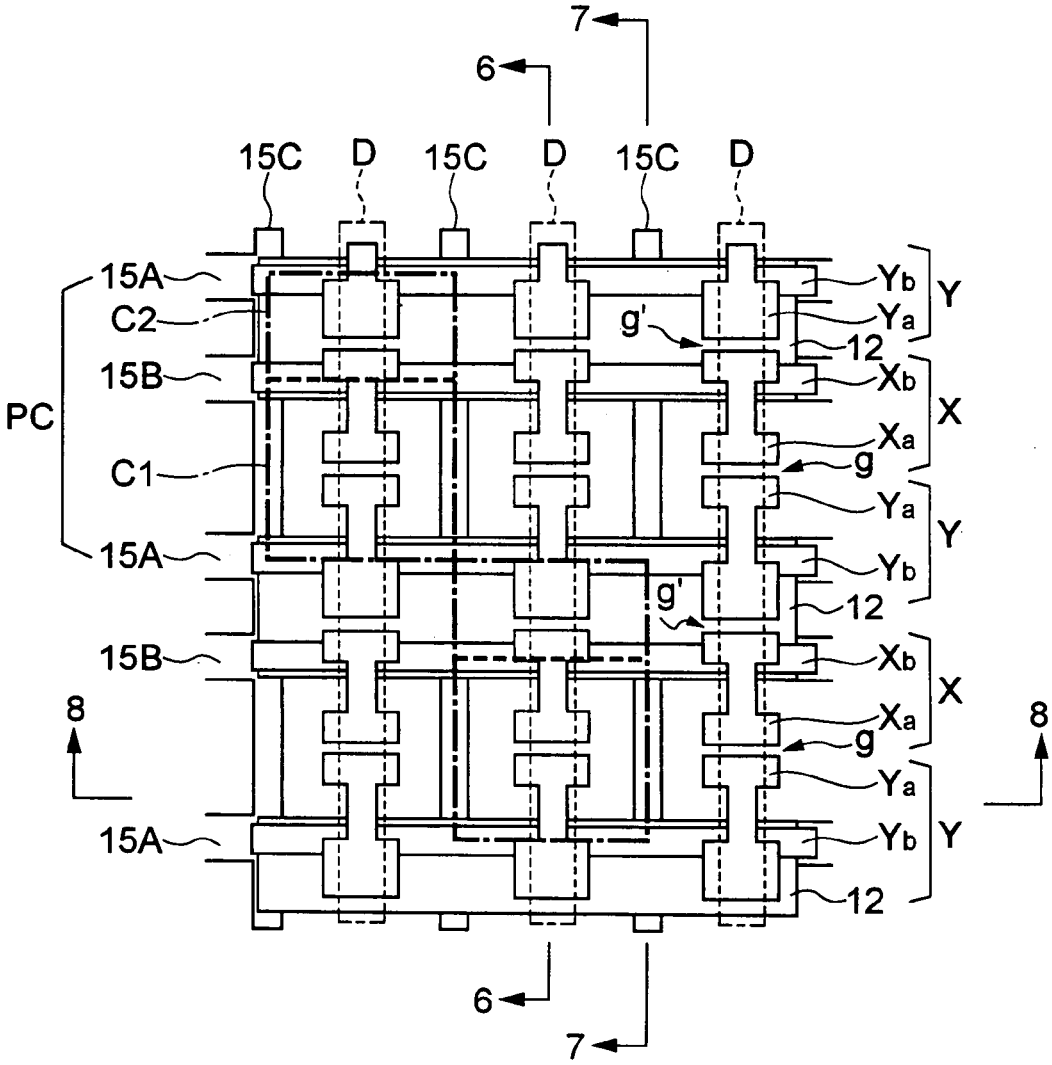
FIG. 5 illustrates a plan view of the PDP, i.e., the drawing when viewed from a display surface side.
Figure 6:
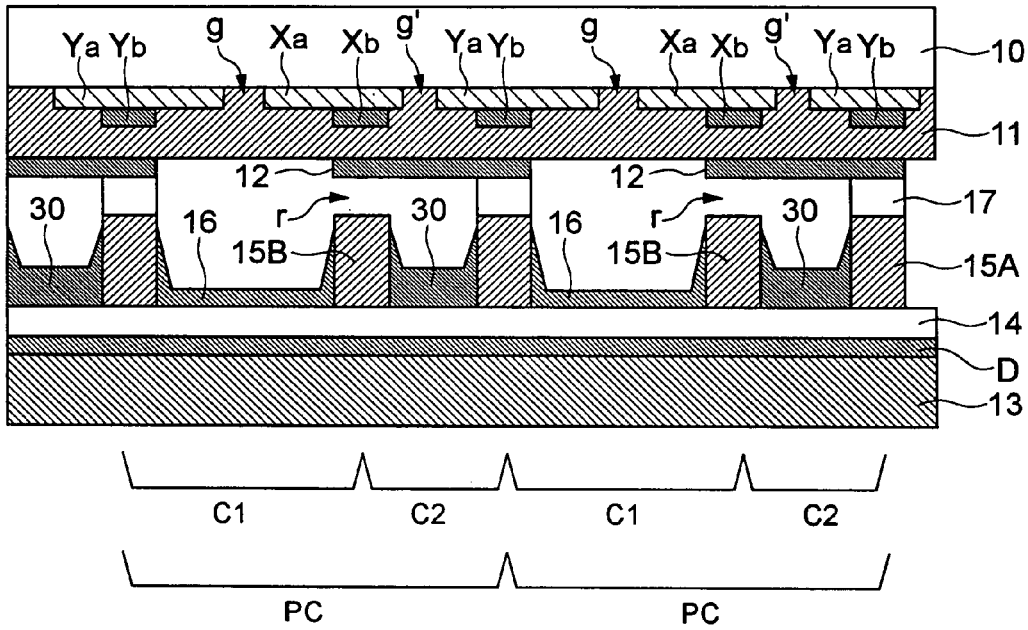
FIG. 6 illustrates the cross sectional view of the PDP as taken along the line 6—6 in FIG. 5.
Figure 7:
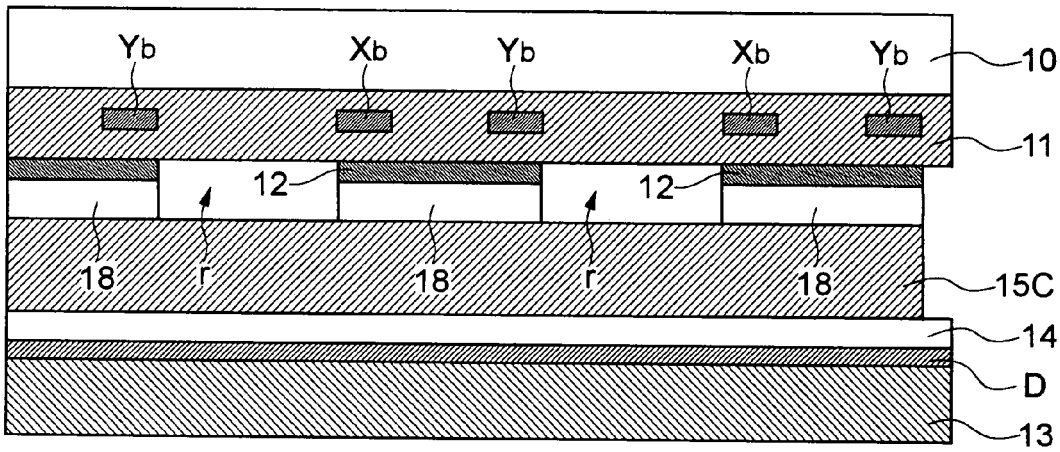
FIG. 7 illustrates the cross sectional view of the PDP as taken along the line 7—7 in FIG. 5.
Figure 8:
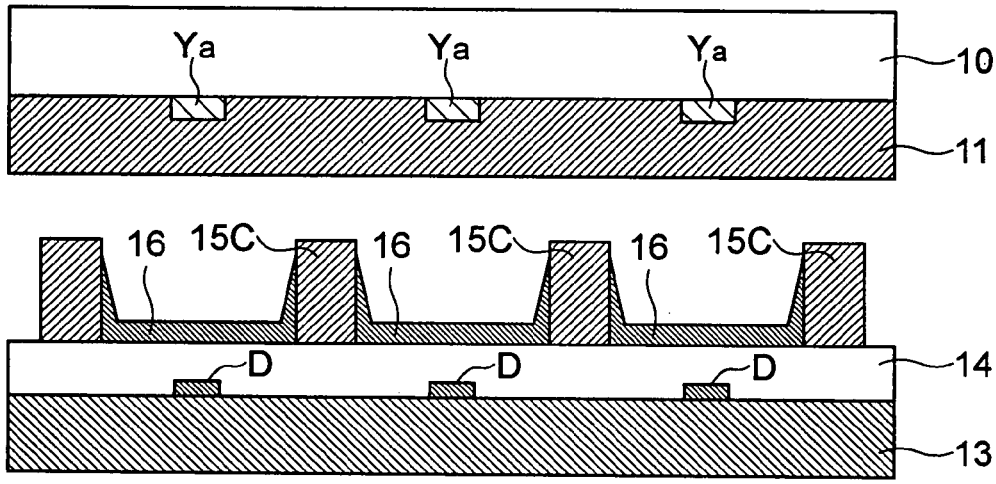
FIG. 8 illustrates the cross sectional view of the PDP as taken along the line 8—8 in FIG. 5.

FIGS. 5 to 8 illustrate part of the inner structure of the PDP 50. Specifically, FIG. 5 illustrates a plan view of the PDP 50, i.e., the drawing when viewed from the display surface side. FIG. 6 illustrates the cross sectional view of the PDP 50 as taken along the line 6—6 in FIG. 5, FIG. 7 illustrates the cross sectional view of the PDP 50 as taken along the line 7—7 in FIG. 5, and FIG. 8 illustrates the cross sectional view of the PDP 50 as taken along the line 8—8 in FIG. 5.

As shown in FIG. 5, each row electrode Y includes a bus electrode Yb (main body of the row electrode Y) extending (elongated) in the horizontal direction of the display surface, and a plurality of transparent electrodes Ya extending from the bus electrode Yb. The bus electrode Yb is made from, for example, a black metallic film. The transparent electrode Ya is a transparent conductive film, made from ITO or the like. The transparent electrodes Ya are located at positions corresponding to the column electrodes D. The transparent electrodes Ya extend perpendicularly to the bus electrode Yb. Each transparent electrode Ya has an enlarged portion at one end thereof and another enlarged portion at the other end thereof. These enlarged portions are elongated in the horizontal direction of the display. It can be said that the transparent electrodes Ya are projecting electrodes, extending from the main body of the row electrode Y. Each row electrode X includes a bus electrode Xb (main body of the row electrode X) extending (elongated) in the horizontal direction of the display surface, and a plurality of transparent electrodes Xa extending from the bus electrode Xb. The bus electrode Xb is made from, for example, a black metallic film. The transparent electrode Xa is a transparent conductive film, made from ITO or the like. The transparent electrodes Xa are located at positions corresponding to the column electrodes D. The transparent electrodes Xa extend perpendicularly to the bus electrode Xb. Each transparent electrode Xa has an enlarged portion at one end thereof and another enlarged portion at the other end thereof. These enlarged portions are elongated in the horizontal direction of the display. It can be said that the transparent electrodes Xa are projecting electrodes of the main body of the row electrode X. The free end of each transparent electrode Xa and the free end of the associated (mating) transparent electrode Ya face each other to form a discharge gap g. In other words, one row electrode X and one row electrode Y in the pair, which define one display line of the PDP, have the projecting transparent electrodes Xa and Ya such that the transparent electrodes Xa and Ya face each other across the discharge gap g. The projecting electrode Ya of the row electrode pair concerned faces a projecting electrode Xa of the adjacent row electrode pair over a similar gap g'.

As shown in FIG. 6, the row electrodes Y and the row electrodes X are formed on the back side of a front glass substrate 10 of the PDP 50. The front glass substrate 10 defines the front surface of the PDP 50. In order to cover or seal the row electrodes X and Y, a dielectric layer 11 is provided on the back side of the front glass substrate 10. Step-like dielectric layers 12 protrude from the dielectric layer 11 toward the back surface of the PDP 50 (downwards in the illustration). The protruding dielectric layers 12 have a certain volume, and are formed at positions corresponding to control discharge cells C2 (will be described) on the surface of the dielectric layer 11. The protruding dielectric layers 12 are light-absorbing layers including black or dark pigment. Each protruding dielectric layer 12 has a strip shape, and extends in the horizontal direction of the PDP 50 as shown in FIG. 5. The surfaces of the protruding dielectric layers 12 and the surface of dielectric layer 11, on which the protruding dielectric layers 12 are not formed, are covered with a protection layer (not shown) made from MgO. A back substrate 13 is provided in parallel to the front glass substrate 10. On the back substrate 13, the column electrodes D extend in the vertical direction of the PDP 50. The column electrodes D are perpendicular to the bus electrodes Xb and Yb. The column electrodes D are parallel to each other at predetermined intervals. A white protection layer 14 is formed over the column electrodes D on the back substrate 13. The protection layer 14 is a dielectric layer. On the column electrode protection layer 14, a partition wall matrix 15 is formed. The partition wall matrix 15 includes first horizontal walls 15A, second horizontal walls 15B and vertical walls 15C. The first and second horizontal walls 15A and 15B extend in the horizontal direction of the PDP 50, and the vertical walls 15C extend in the vertical direction of the PDP 50. The first horizontal walls 15A are formed on the column electrode protection layer 14 below the bus electrodes Yb. The second horizontal walls 15B are formed on the column electrode protection layer 14 below the bus electrodes Xb. The vertical walls 15C extend between the transparent electrodes Xa and between the transparent electrodes Ya (FIG. 5). The transparent electrodes Xa (Ya) are arranged on the associated bus electrode Xb (Yb) at equal intervals. The vertical walls 15C extend perpendicularly to the bus electrodes Xb and Yb. As shown in FIG. 6, a secondary electron emission material layer 30 is formed on the column electrode protection layer 14 below each protruding dielectric layer 12. The secondary electron emission layer 30 also extends over the surface of the first horizontal wall 15A, second horizontal wall 15B and vertical wall 15C. The secondary electron emission layer 30 has a low work function (e.g., 4.2 eV or less), and is made from a high γ material. In other words, a so-called secondary electron emission coefficient of the secondary electron emission layer 30 should be high. A suitable material for the secondary electron emission layer 30 is, for example, alkali rare earth metallic oxide (e.g., MgO, CaO, SrO or BaO), alkali metallic oxide (e.g., Cs2), fluorine compound (e.g., CaF2 or MgF2), TiO2, Y2O, or a material having an increased secondary electron emission coefficient. The secondary electron emission coefficient can be increased by crystal defect and impurity-doping. A fluorescent layer 16 is formed on the column electrode protection layer 14 below the dielectric layer 11 not covered by the protruding dielectric layer 12. The fluorescent layer 16 also extends over the surface of the first horizontal wall 15A, second horizontal wall 15B and vertical wall 15C. The fluorescent layer 16 has three types of layers; a red fluorescent layer to emit red light, a green fluorescent layer to emit green light, and a blue fluorescent layer to emit blue light. Each pixel cell PC has a predetermined type of layer to emit light of a particular color. A discharge gas is sealed in the space between the layers 16, 30 and the layers 11, 12 to form discharge space. As shown in FIGS. 6 and 8, the first horizontal wall 15A, second horizontal wall 15B and vertical wall 15C are not so tall that they do not reach the dielectric layers 11 and 12. As understood from FIG. 6, therefore, a clearance r remains between the second horizontal wall 15B and the protruding dielectric layer 12. In order to prevent passage of a discharge gas, however, a dielectric layer 17 is formed between the first horizontal wall 15A and the protruding dielectric layer 12. The dielectric layer 17 extends along the first horizontal wall 15A. Likewise, as shown in FIG. 7, a dielectric layer 18 is formed between the vertical wall 15C and the protruding dielectric layer 12. The dielectric layer 18 extends intermittently along the first horizontal wall 15C.

Referring back to FIG. 5, an area enclosed by two first horizontal walls 15A and two vertical walls 15C, as indicated by the single-dot chain line, is a pixel cell PC. The pixel cell PC defines a unit area of light emission, or a light emission element. Three pixel cells form one pixel. As understood from FIGS. 5 and 6, the pixel cell PC is divided into a display discharge cell C1 and a control discharge cell C2 by the second horizontal wall 15B. The display discharge cell C1 includes the transparent electrodes Xa and Ya of a row electrode pair for one display line and the fluorescent layer 16. The control discharge cell C2 includes the protruding dielectric layer 12, the secondary electron emission layer 30, the transparent electrode Xa of the row electrode X of the display line concerned, and a transparent electrode Ya of a row electrode Y of a display line immediately above the display line concerned. The discharge gap (first discharge gap) g between the enlarged end of the transparent electrode Xa and the enlarged end of the transparent electrode Ya is located in the middle of the bus electrodes Xb and Yb within the display discharge cell C1. In the control discharge cell C2, however, the discharge gap (second discharge gap) g' is located closer to the bus electrode Xb than the bus electrode Yb. If the first discharge gaps gin one display line are particularly concerned, it can be said that each row electrode X/Y has a plurality of first portions and second portions directed in the vertical direction of the PDP 50, and the first portions of the X row electrode face the first portions of the Y row electrode in each row electrode pair over the first discharge gaps g, respectively. The second portions of the X row electrode in the same row electrode pair face the second portions of the Y row electrode in the upper row electrode pair over the second discharge gap g'. The first discharge gap g in the display discharge cell C1 is formed between the two mating first portions of the two electrodes X and Y of each row electrode pair, and the second discharge gap g' in the control discharge cell C2 is formed between the second portion of the electrode X of the row electrode pair concerned and the second portion of the electrode Y of the adjacent row electrode pair. In this embodiment, the first discharge gap g is equal to (is the same as) the second discharge gap g'.

In the height direction (right and left directions in FIG. 6) of the PDP 50, the discharge space of one pixel cell PC is separated from the discharge space of the adjacent pixel cell PC by the first horizontal wall 15A and the associated dielectric layer 17 between these two pixel cells. The discharge space for the display discharge cell C1 and the discharge space for the control discharge cell C2 within the same pixel cell PC are communicated with each other through the clearance r. In the width direction of the PDP 50, the discharge space for one control discharge cell C2 is separated from the discharge space for the adjacent control discharge cell C2 by the protruding dielectric layer 12 and the associated dielectric layer 18, as shown in FIG. 7. On the other hand, the discharge space for one display discharge cell C1 is communicated with the discharge space for the adjacent display discharge cell C1.

In this manner, each of the pixel cells $PC_{1,1}$ to $PC_{n-1'm}$ of the PDP 50 includes the display discharge cell C1 and the control discharge cell C2, and the discharge space of the display discharge cell C1 is communicated with the discharge space of the control discharge cell C2.

The odd-number X electrode driver 51 supplies drive pulses (will be described) to the odd-number electrodes $X_3$, $X_5, \ldots, X_{n-2}$, and $X_n$ of the PDP 50 (see FIG. 4) in response to the timing signals supplied from the drive control circuit 56. The even-number X electrode driver 52 supplies drive pulses (will be described) to the even-number electrodes $X_2$, $X_4, \ldots, X_{n-3}$, and $X_{n-1}$ of the PDP 50 in response to the timing signals supplied from the drive control circuit 56. The odd-number Y electrode driver 53 supplies drive pulses (will be described) to the odd-number electrodes $Y_1, Y_3, Y_5, \ldots, Y_{n-2}$, and $Y_n$ of the PDP 50 in response to the timing signals supplied from the drive control circuit 56. The even-number Y electrode driver 54 supplies drive pulses (will be described) to the even-number electrodes $Y_2, Y_4, \ldots, Y_{n-3}$, and $Y_{n-1}$ of the PDP 50 in response to the timing signals supplied from the drive control circuit 56. The address driver 55 feeds pixel data pulses (will be described) to the column electrodes $D_1$ to $D_m$ of the PDP 50 in response to the timing signals supplied from the drive control circuit 56.

The drive control circuit 56 first converts each pixel of the input image signal into, for example, pixel data of 8 bits which represent luminance levels, and applies an error diffusion processing and a dither processing to the pixel data. For instance, in the error diffusion processing, the upper six bits of the pixel data is defined as display data, and the remaining lower two bits thereof is defined as error data. Then, the error data of the pixel data is weighted based on the surrounding pixels, and the result is reflected on the display data of the surrounding pixels. According to such operation, the pseudo luminance for the lower two bits in an original pixel is expressed by the surrounding pixels. Therefore, the display data for six bits (not eight bits) can express the luminance gradation sequence equivalent to the 8-bit pixel data. In this manner, the error-diffusion-processed pixel data of six bits is obtained by the error diffusion processing. Then, the dither processing is applied to the 6-bit error-diffusion-processed pixel data. In the dither processing, a plurality of pixels abutting with each other are defined as one pixel unit, and dither coefficients having different coefficient values are allocated to the error diffusion processed pixel data of the pixels within this one pixel unit, respectively, and the resulting data are added to each other to obtain the dither-added pixel data. As a result of such addition of the dither coefficients, if viewed as the pixel unit, the upper four bits of the dither-added pixel data is sufficient to express the luminance equivalent to the eight-bit pixel data. Thus, the drive control circuit 56 uses the upper four bits of the dither-added pixel data as the multi-gradation (grayscale) image data $PD_S$, and converts the 4-bit multi-gradation image data $PD_S$ into the 15-bit pixel driving data GD having the first to fifteenth bits in accordance with a conversion table shown in FIG. 9. The symbol * in the conversion table in FIG. 9 indicates that the logical level can take either 1 or 0. In this way, the pixel data which can express 256 gradation levels in eight bits is converted into the pixel driving data GD of fifteen bits including sixteen patterns in total as shown in FIG. 9. Subsequently, the drive control circuit 56 divides the pixel driving data $GD_{1,1}$ to $GD_{(n-1),m}$ into pixel driving data bit groups DB1 to DB15 as shown below:

DB1: group of first bits of the pixel driving data $GD_{1,1}$ to $GD_{(n-1),m}$ DB2: group of second bits of the pixel driving data $GD_{1,1}$ to $GD_{(n-1),m}$ DB3: group of third bits of the pixel driving data $GD_{1,1}$ to $GD_{(n-1),m}$ DB4: group of fourth bits of the pixel driving data $GD_{1,1}$ to $GD_{(n-1),m}$ DB5: group of fifth bits of the pixel driving data $GD_{1,1}$ to $GD_{(n-1),m}$ DB6: group of sixth bits of the pixel driving data $GD_{1,1}$ to $GD_{(n-1),m}$ DB7: group of seventh bits of the pixel driving data $GD_{1,1}$ to $GD_{(n-1),m}$ DB8: group of eighth bits of the pixel driving data $GD_{1,1}$ to $GD_{(n-1),m}$ DB9: group of ninth bits of the pixel driving data $GD_{1,1}$ to $GD_{(n-1),m}$ DB10: group of tenth bits of the pixel driving data $GD_{1,1}$ to $GD_{(n-1),m}$ DB11: group of eleventh bits of the pixel driving data $GD_{1,1}$ to $GD_{(n-1),m}$ DB12: group of twelfth bits of the pixel driving data $GD_{1,1}$ to $GD_{(n-1),m}$ DB13: group of thirteen bits of the pixel driving data $GD_{1,1}$ to $GD_{(n-1),m}$ DB14: group of fourteen bits of the pixel driving data $GD_{1,1}$ to $GD_{(n-1),m}$ and DB15: group of fifteen bits of the pixel driving data $GD_{1,1}$ to $GD_{(n-1),m}$.

The pixel driving data $GD_{1,1}$ to $GD_{(n-1),m}$ define one screen, and the drive control circuit 56 divides (groups) the pixel driving data $GD_{1,1}$ to $GD_{(n-1),m}$ in terms of bit-digit. The drive control circuit 56 performs this grouping for every screen.

The pixel driving data bit groups DB1 to DB15 correspond to the subfields SF1 to SF15, respectively. The drive control circuit 56 supplies m pixel driving data bit groups DB to the address driver 55 for one display line at a time. The pixel driving data bit groups are supplied for each of the subfields SF1 to SF15. The pixel driving data bit groups to be supplied are selected depending upon the subfield SF concerned.

Figure 10:
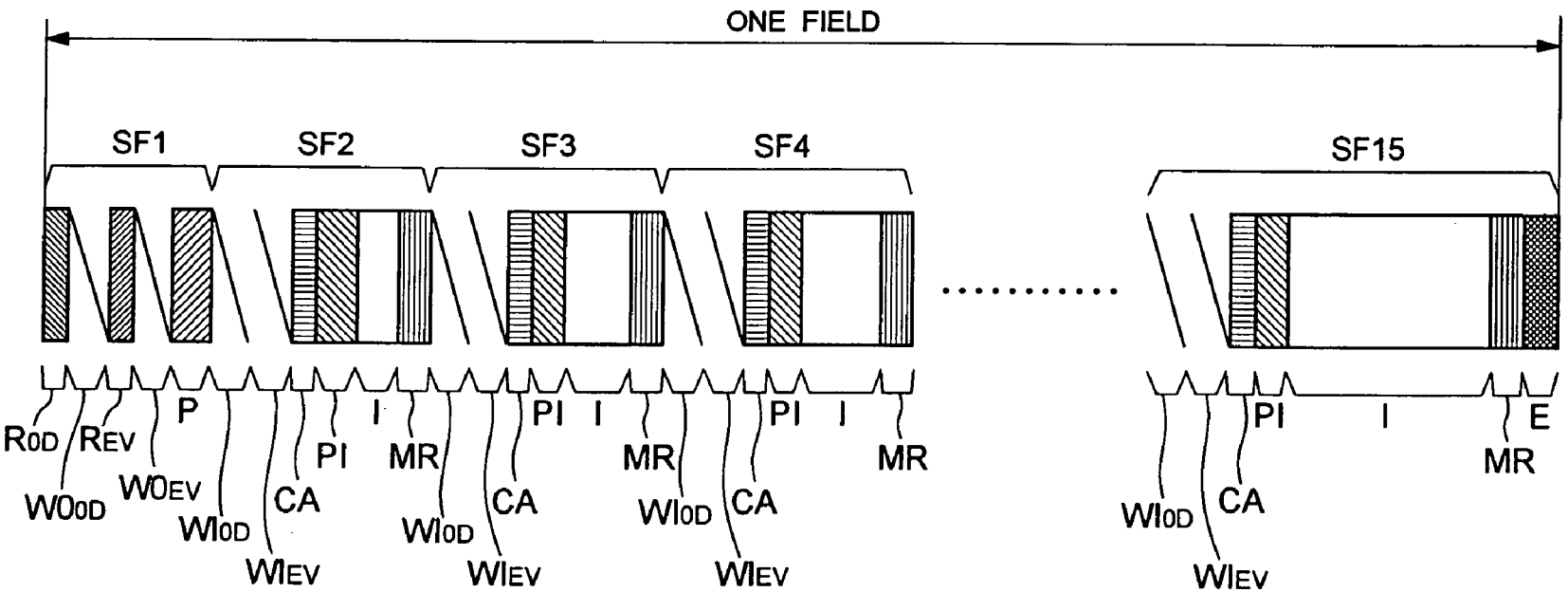
FIG. 10 shows a light emission drive format used for the PDP apparatus shown in FIG. 4.

In accordance with a light emitting driving sequence shown in FIG. 10, the drive control circuit 56 generates various timing signals to drive the PDP 50, and supplies the timing signals to the odd number X electrode driver 51, even number X electrode driver 52, odd number Y electrode driver 53 and even number Y electrode driver 54.

In the light emission driving sequence shown in FIG. 10, each field of the image signal is divided into fifteen subfields SF1 to SF15, and a PDP driving pattern is carried out in each subfield as described below.

In the first subfield SF1, the odd row rest stage $R_{OD}$, the odd row address stage $WO_{OD}$, the even row rest stage $R_{EV}$, the even row address stage $WO_{EV}$, and the priming stage P are sequentially performed. In each of the subfields SF2 to SF15, the odd row address stage $WI_{OD}$, the even row address stage $WI_{EV}$, the selective light extinction assisting stage CA, the priming stage P1, the light emission sustaining stage I, and the electric charge movement stage MR are sequentially performed. In the last subfield SF15 only, the light extinction stage E is performed after the electric charge movement stage MR.

Figure 11:
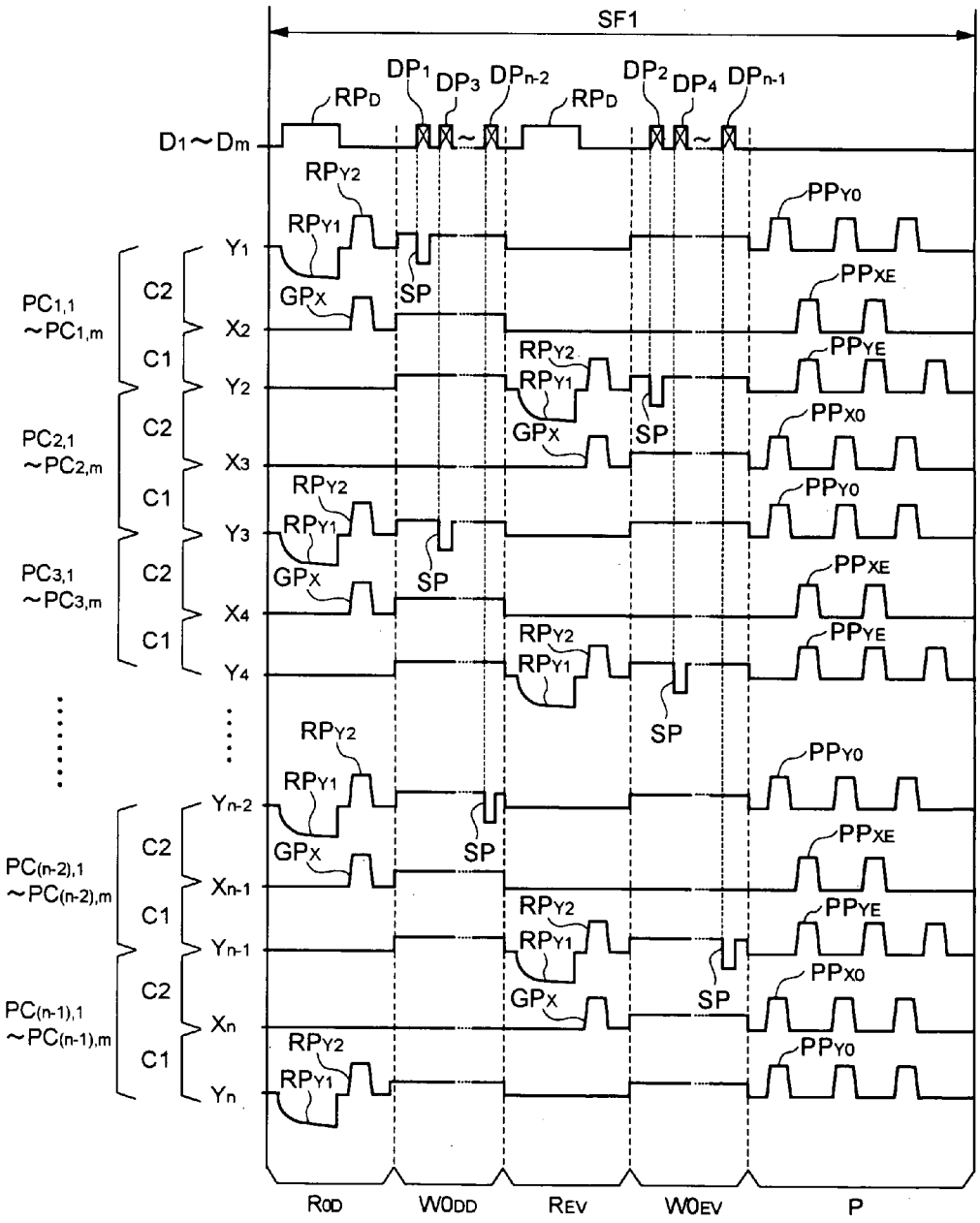
FIG. 11 is a diagram for showing various drive pulses applied to the PDP in the first subfield.
Figure 12:
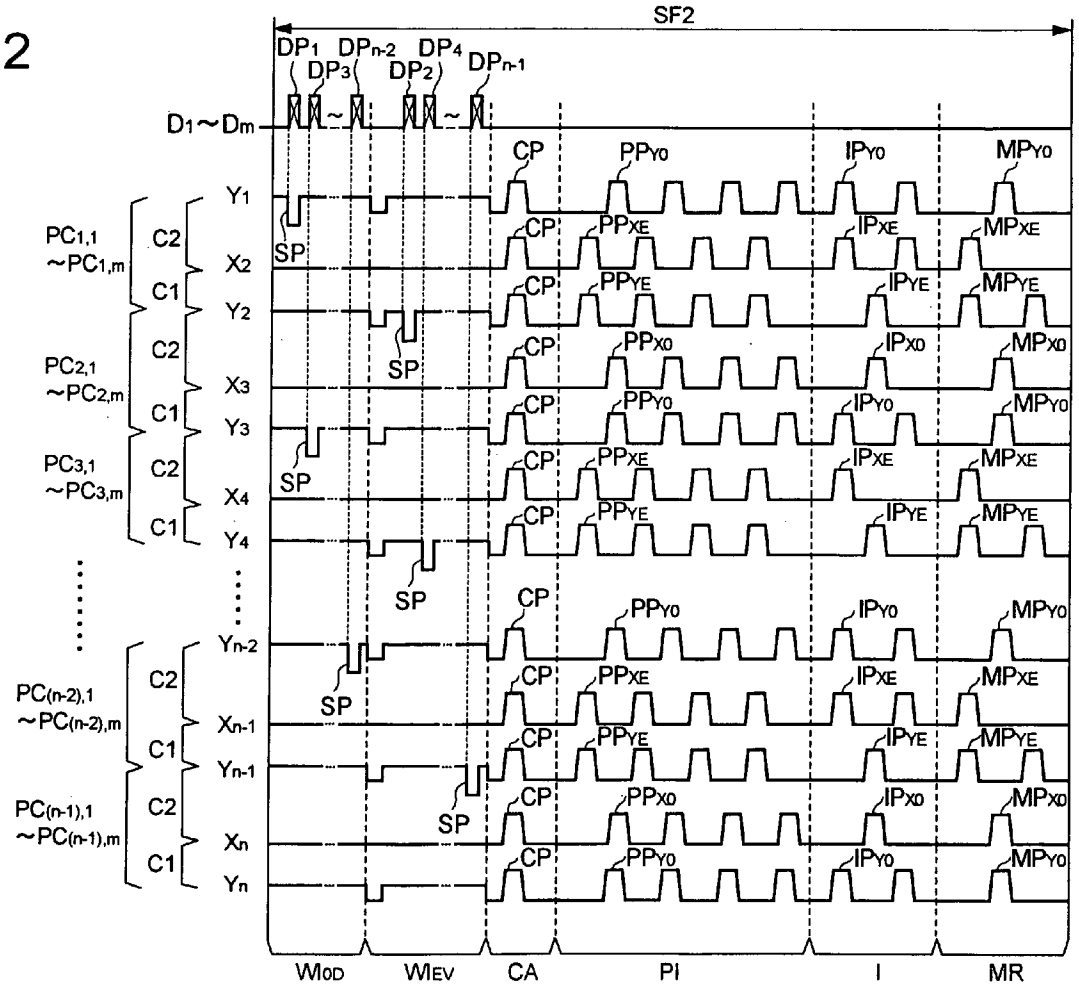
FIG. 12 is a diagram for showing various drive pulses applied to the PDP in the second subfield.
Figure 13:
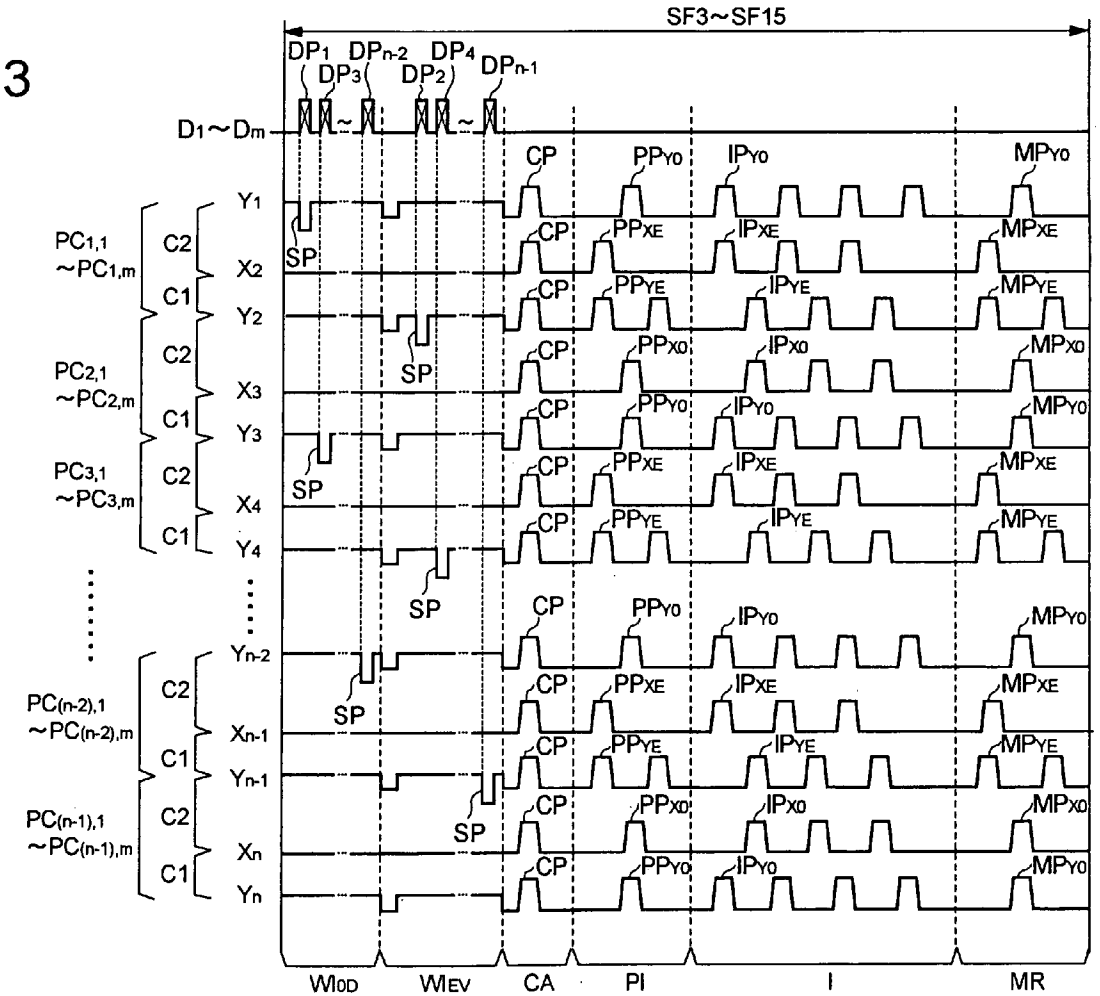
FIG. 13 is a diagram for showing various drive pulses applied to the PDP in the third to fifteenth subfields.

FIGS. 11 to 13 illustrate charts of drive pulses and application timing, which are applied to the PDP 50 from the odd X electrode driver 51, even X electrode driver 52, odd Y electrode driver 53, even Y electrode driver 54 and address driver 55. FIG. 11 shows the timing chart for the first subfield SF1, FIG. 12 shows the timing chart for the second subfield SF2, and FIG. 13 shows the timing chart for each of the third to fifteenth subfields SF3 to SF15.

First, in the odd row reset stage $R_{OD}$ of the subfield SF1, the odd Y electrode driver 53 generates the first reset pulse $RP_{Y1}$ having a negative polarity and supplies the first rest pulse to the odd row electrodes $Y_1$, $Y_3$, $Y_5$, . . . , and $Y_n$ simultaneously. The first reset pulse $RP_{Y1}$ has gentle rise and fall edges, as compared with a light emission sustaining pulse (will be described). In the meanwhile, the address driver 55 generates a reset pulse $RP_D$ having a positive polarity and supplies the rest pulse $RP_D$ to the column electrodes $D_1$ to $D_n$ simultaneously. In response to the first reset pulse $RP_{Y1}$ and reset pulse $RP_D$, first reset discharge (writing discharge) is caused in the control discharge cell C2 of each of the pixel cells $PC_{1,1}$ to $PC_{1,m}$, $PC_{3,1}$, to $PC_{3,m}$, . . . , and $PC_{n-2,1}$ to $PC_{n-2,m}$ which belong to the odd display lines. In other words, the first reset discharge occurs between the row electrode Y and the column electrode D in the control discharge cell C2 (FIGS. 5 and 6), and the first reset discharge creates the wall charge in the control discharge cell C2 of each of the pixel cells PC which belong to the odd display lines. In the odd row rest stage $R_{OD}$, after the first rest pulse $RP_{Y1}$ is applied, the odd Y electrode driver 53 supplies a second reset pulse $RP_{Y2}$ having a positive polarity (FIG. 11) to the odd row electrodes $Y_1$, $Y_3$, . . . , and $Y_n$ simultaneously. In response to the second reset pulse $RP_{Y2}$, second reset discharge (light extinction discharge) is caused in the control discharge cell C2 of each of the pixel cells PC which belong to the odd display lines. In other words, the second reset discharge occurs between the row electrode Y and the column electrode D in the control discharge cell C2 (FIGS. 5 and 6), and the second reset discharge eliminates the wall charge in the control discharge cell C2 of each of the pixel cells PC which belong to the odd display lines. In order to prevent erroneous (accidental) discharge from occurring between the row electrode X and column electrode D in the control discharge cell C2, the even number X electrode driver 52 supplies pulses $GP_X$ having a positive polarity (FIG. 11) to the even number row electrodes $X_2$, $X_4$, $X_6$, . . . , and $X_{n-1}$ at the same timing as the second reset pulse $RP_{Y2}$. The pulse $GP_X$ may be referred to as erroneous discharge prevention pulse.

As described above, in the odd row rest stage $R_{OD}$, the wall charge is simultaneously eliminated from the control discharge cells C2 of the pixel cells $PC_{1,1}$ to $PC_{1,m}$, $PC_{3,1}$ to $PC_{3,m}$, . . . , and $PC_{n-2,1}$ to $PC_{n-2,m}$ which belong to the odd display lines of the PDP 50 so that all the pixel cells PC on the odd display lines are initialized into the light extinct condition.

In the odd row addressing stage $WO_{OD}$ of the subfield SF1, the odd Y electrode driver 53 supplies scanning pulses SP having a negative polarity to the odd row electrodes $Y_1$, $Y_3$, $Y_5$, . . . , and $Y_n$ of the PDP 50 sequentially. In the meanwhile, the address driver 55 finds those data bits in the pixel drive data bit group DB1 of the subfield SF1 which correspond to the odd display lines, and converts such data bits into pixel data pulses DP having a pulse voltage corresponding to the logic levels of these data bits. For example, the address driver 55 converts a pixel drive data bit having a logic level 1 into a high-voltage pixel data pulse PD of positive polarity, and converts a pixel drive data bit having a logic level 0 into a low-voltage (zero volt) pixel data pulse PD. The address driver 55 then supplies m pixel data pulses DP to the column electrodes $D_1$ to $D_m$ at a time for each display line, in synchronization with the application timing of the scanning pulses SP. In short, the address driver 55 converts the pixel drive data bits for the odd display lines $DB_{1,1}$ to $DB_{1,m}$, $DB_{3,1}$ to $DB_{3,m}$, . . . , and $DB_{n-2,1}$ to $DB_{n-2,m}$ into the pixel data pulses $DP_{1,1}$ to $DP_{1,m}$, $DP_{3,1}$ to $DP_{3,m}$, . . . , and $DP_{n-2,1}$ to $DP_{n-2,m}$, and applies the pixel data pulses to the column electrodes $D_1$ to $D_m$ for each of the display lines.

Write address discharge is caused between the column electrode D and bus electrode Yb in the control discharge cell C2 of the pixel cell PC to which the scanning pulse SP and the high-voltage pixel data pulse DP are both applied. Accordingly, wall charge is created in the control discharge cell C2. On the other hand, the write address discharge is not caused in the control discharge cell C2 of the pixel cell PC to which the scanning pulse SP is applied and the high-voltage pixel data pulse DP is not applied. Accordingly, no wall charge is created in such control discharge cell C2. In the meantime, in order to prevent accidental (unintended) discharge from occurring between the bus electrodes Xb of the even row electrodes $X_2$, $X_4$, $X_6$, . . . , and $X_{n-1}$ and the column electrodes D, the even X electrode driver 52 supplies a voltage having the same polarity as the pixel data pulse DP to each of the even row electrodes X.

As described above, in the odd row addressing stage $WO_{OD}$, the write address discharge is selectively triggered and the wall charge is selectively produced in the control discharge cell C2 of each of the pixel cells PC which belong to the odd display lines of the PDP 50, in accordance with the pixel drive data bit group DB1 (group of first bits of the pixel drive data GD shown in FIG. 9). As a result, the pixel cells PC on the odd display lines are set to either a provisional light emission condition (wall charge presents in the control discharge cell C2) or a light extinct condition (no wall charge presents in the control discharge cell C2).

In the even row reset stage $R_{EV}$ of the subfield SF1, the even Y electrode driver 54 generates the first reset pulse $RP_{Y1}$ having a negative polarity and supplies the first rest pulse to the even row electrodes $Y_2$, $Y_4$, . . . , and $Y_{n-1}$ of the PDP 50 simultaneously. The first reset pulse $RP_{Y1}$ has gently sloped rising and falling edges, as compared with the light emission sustaining pulse. In the meanwhile, the address driver 55 generates the reset pulse $RP_D$ having the positive polarity and supplies the rest pulse $RP_D$ to the column electrodes $D_1$ to $D_n$ simultaneously. In response to the first reset pulse $RP_{Y1}$ and reset pulse $RP_D$, the first reset discharge (writing discharge) is caused in the control discharge cell C2 of each of the pixel cells $PC_{2,1}$ to $PC_{2,m}$, $PC_{4,1}$ to $PC_{4,m}$, . . . , and $PC_{n-1,1}$ to $PC_{n-1,m}$ which belong to the even display lines. In other words, the first reset discharge occurs between the row electrode Y and the column electrode D in the control discharge cell C2 (FIG. 5 and FIG. 6), and the first reset discharge creates the wall charge in the control discharge cell C2 of each of the pixel cells PC which belong to the even display lines. In the even row rest stage $R_{EV}$, after the first rest pulse $RP_{Y1}$ is applied, the even Y electrode driver 54 supplies the second reset pulse $RP_{Y2}$ having the positive polarity (FIG. 11) to the even row electrodes $Y_2$, $Y_4$, . . . , and $Y_{n-1}$ simultaneously. In response to the second reset pulse $RP_{Y2}$, the second reset discharge (light extinction discharge) is caused in the control discharge cell C2 of each of the pixel cells PC which belong to the even display lines. In other words, the second reset discharge occurs between the row electrode Y and the column electrode D in the control discharge cell C2 (FIGS. 5 and 6), and the second reset discharge eliminates the wall charge in the control discharge cell C2 of each of the pixel cells PC which belong to the even display lines. In order to prevent erroneous discharge from occurring between the row electrode X and column electrode D in the control discharge cell C2, the odd X electrode driver 51 supplies the pulses $GP_X$ having the positive polarity (FIG. 11) to the odd row electrodes $X_3$, $X_5$, . . . , and $X_n$ at the same timing as the second reset pulse $RP_{Y2}$. The pulse $GP_X$ are the erroneous discharge prevention pulse.

As described above, in the even row rest stage $R_{EV}$, the wall charge is simultaneously eliminated from the control discharge cells C2 of the pixel cells $PC_{2,1}$ to $PC_{2,m}$, $PC_{4,1}$ to $PC_{4,m}$, . . . , and $PC_{n-,1}$ to $PC_{n-,m}$ which belong to the even display lines of the PDP 50 so that all the pixel cells PC on the even display lines are initialized into the light extinct condition.

In the even row addressing stage $WO_{EV}$ of the subfield SF1, the even Y electrode driver 54 supplies the scanning pulses SP having the negative polarity to the even row electrodes $Y_2$, $Y_4$, . . . , $Y_{n-1}$, of the PDP 50 sequentially. In the meanwhile, the address driver 55 finds those data bits in the pixel drive data bit group DB1 of the subfield SF1 which correspond to the even display lines, and converts such data bits into pixel data pulses DP having the pulse voltage corresponding to the logic levels of these data bits. For example, the address driver 55 converts a pixel drive data bit having a logic level 1 into a high-voltage pixel data pulse DP of positive polarity, and converts a pixel drive data bit having a logic level 0 into a low-voltage (zero volt) pixel data pulse DP. The address driver 55 then supplies m pixel data pulses DP to the column electrodes $D_1$ to $D_m$ at a time for each display line, in synchronization with the application timing of the scanning pulses SP. In short, the address driver 55 converts the pixel drive data bits for the even display lines $DB1_{2,1}$ to $DB1_{2,m}$, $DB1_{4,1}$ to $DB1_{4,m}$, . . . , and $DB_{n-1,1}$ to $DB1_{n-1,m}$ into the pixel data pulses $DP_{2,1}$ to $DP_{2,m}$, $DP_{4,1}$ to $DP_{4,m}$, . . . , and $DP_{n-1,1}$ to $DP_{n-1,m}$, and applies the pixel data pulses to the column electrodes $D_1$ to $D_m$ for each of the display lines. Write address discharge is caused between the column electrode D and bus electrode Yb in the control discharge cell C2 of the pixel cell PC to which the scanning pulse SP and the high-voltage pixel data pulse DP are both applied. Accordingly, the wall charge is created in the control discharge cell C2. On the other hand, the write address discharge is not caused in the control discharge cell C2 of the pixel cell PC to which the scanning pulse SP is applied and the high-voltage pixel data pulse DP is not applied. Accordingly, no wall charge is created in such control discharge cell C2. In the meantime, in order to prevent accidental discharge from occurring between the bus electrodes Xb of the odd row electrodes $X_3$, $X_5$, . . . , and $X_n$ and the column electrodes D, the odd X electrode driver 51 supplies a voltage having the same polarity as the pixel data pulse DP to each of the odd row electrodes X.

As described above, in the even row addressing stage $WO_{EV}$, the wall charge is selectively generated in the control discharge cells C2 of the pixel cells PC on the even display lines of the PDP 50, in accordance with the pixel drive data bit group DB1 (first bits of the pixel drive data GD in FIG. 9). As a result, the pixel cells PC belonging to the even display lines are set to either the provisional light emission condition (wall charge presents in the control discharge cell C2) or the light extinct condition (no wall charge presents in the control discharge cell C2).

In the priming stage P of the subfield SF1, the odd Y electrode driver 53 intermittently generates priming pulses $PP_{YO}$ having a positive polarity, as shown in FIG. 11, for a predetermined number of times, and supplies the priming pulses to the odd row electrodes $Y_1$, $Y_3$, . . . , and $Y_n$ of the PDP 50. In the priming stage P, the odd X electrode driver 51 also intermittently generates priming pulses $PP_{XO}$ having a positive polarity, as shown in FIG. 11, for a predetermined number of times, and supplies the priming pulses to the odd row electrodes $X_3$, $X_5$, . . . , and $X_n$ of the PDP 50. As understood from FIG. 11, the priming pulses $PP_{YO}$ and $PP_{XO}$ are applied at the same timing. In the priming stage P, the even X electrode driver 52 intermittently generates priming pulses $PP_{XE}$ having a positive polarity, as shown in FIG. 11, for a predetermined number of times, and supplies the priming pulses to the even row electrodes $X_2$, $X_4$, . . . , and $X_{n-1}$ of the PDP 50. In the priming stage P, the even Y electrode driver 54 also intermittently generates priming pulses $PP_{YE}$ having a positive voltage value for a predetermined number of times, and supplies the priming pulses to the even row electrodes $Y_2$, $Y_4$, . . . , $Y_{n-2}$ and $Y_n$ of the PDP 50. As understood from FIG. 11, the application timing of the priming pulses $PP_{XE}$ and $PP_{YE}$ to the even row electrodes X and Y is different from the application timing of the priming pulses $PP_{XO}$ and $PP_{YO}$ to the odd row electrodes X and Y. Every time the priming pulse $PP_{XO}$, $PP_{XE}$, $PP_{YO}$ or $PP_{YE}$ is applied, the priming discharge is produced within the control discharge cell C2 of the pixel cell PC in the provisional light emission condition. Accordingly, the wall charge is accumulated in the control discharge cell C2.

As described above, in the priming stage P, the priming discharge takes place in the control discharge cells C2 of the pixel cells PC which are set to the provisional light emission condition during the odd row addressing stage $WO_{OD}$ or the even row address stage $WO_{EV}$. As a consequence, a certain amount of wall charge which is sufficient to cause the discharge with a relatively low voltage is accumulated in the control discharge cell(s) C2.

In the odd row addressing stage $WI_{OD}$ of each of the subfields SF2 to SF15 (referred to as SFj; j=2 to 15), the odd Y electrode driver 53 supplies the scanning pulses SP having the negative polarity to the odd row electrodes $Y_1$, $Y_3$, $Y_5$, . . . , and $Y_n$ of the PDP 50 sequentially. In the meanwhile, the address driver 55 finds those data bits in the pixel drive data bit group DBj of the subfield SFj which correspond to the odd display lines, and converts such data bits into pixel data pulses DP having pulse voltages corresponding to the logic levels of these data bits. For example, the address driver 55 converts a pixel drive data bit having a logic level 1 into a high-voltage pixel data pulse DP of positive polarity, and converts a pixel drive data bit having a logic level 0 into a low-voltage (zero volt) pixel data pulse DP. The address driver 55 then supplies m pixel data pulses DP to the column electrodes $D_1$ to $D_m$ at a time for each display line, in synchronization with the application timing of the scanning pulses SP. In short, the address driver 55 converts the pixel drive data bits for the odd display lines $DBj_{1,1}$ to $DBj_{1,m}$, $DBj_{3,1}$ to $DBj_{3,m}$, . . . , and $DBj_{n-2,1}$ to $DBj_{n-2,m}$ into the pixel data pulses $DP_{1,1}$ to $DP_{1,m}$, $DP_{3,1}$ to $DP_{3,m}$, . . . , and $DP_{n-2,1}$ to $DP_{n-2,m}$, and applies the pixel data pulses to the column electrodes $D_1$ to $D_m$ for each of the display lines. Light extinction address discharge is caused between the column electrode D and bus electrode Yb in the control discharge cell C2 of the pixel cell PC to which the scanning pulse SP and the high-voltage pixel data pulse DP are both applied. Accordingly, the wall charge is eliminated in the control discharge cell C2. On the other hand, the light extinction address discharge is not caused in the control discharge cell C2 of the pixel cell PC to which the scanning pulse SP is applied and the high-voltage pixel data pulse DP is not applied. Accordingly, presence/non-presence of the wall charge in such control discharge cell C2 is maintained. If the wall charge is present in the control discharge cell C2, the wall charge is maintained. If the wall charge is not present in the control discharge cell C2, no wall charge is created in the control discharge cell C2. In the meantime, in order to prevent unintended discharge from occurring between the bus electrodes Xb of the even row electrodes $X_2$, $X_4$, $X_6$, . . . , and $X_{n-1}$ and the column electrodes D, the even X electrode driver 52 supplies a voltage having the same polarity as the pixel data pulse DP to each of the even row electrodes X.

As described above, in the odd row addressing stage $WI_{OD}$, the light extinction address discharge is selectively caused and the wall charge is selectively eliminated in the control discharge cells C2 of the pixel cells PC which belong to the odd display lines of the PDP 50, in accordance with the pixel drive data bit group DBj (j'th bits of the pixel drive data GD for the subfield SFj). As a result, the pixel cells PC on the odd display lines are set to either a provisional light emission condition (wall charge presents in the control discharge cell C2) or a light extinct condition (no wall charge presents in the control discharge cell C2).

In the even row addressing stage $WI_{EV}$ of the subfield SFj (SF2 to SF15), the even Y electrode driver 54 supplies the scanning pulses SP having the negative polarity to the even row electrodes $Y_2$, $Y_4$, . . . , $Y_{n-1}$ of the PDP 50 sequentially. In the meanwhile, the address driver 55 finds those data bits in the pixel drive data bit group DBj of the subfield SFj which correspond to the even display lines, and converts such data bits into pixel data pulses DP having the pulse voltage corresponding to the logic levels of these data bits. For example, the address driver 55 converts a pixel drive data bit having a logic level 1 into a high-voltage pixel data pulse DP of positive polarity, and converts a pixel drive data bit having a logic level 0 into a low-voltage (zero volt) pixel data pulse DP. The address driver 55 then supplies m pixel data pulses DP to the column electrodes $D_1$ to $D_m$ at a time for each display line, in synchronization with the application timing of the scanning pulses SP. In short, the address driver 55 converts the pixel drive data bits for the even display lines $DBj_{2,1}$ to $DBj_{2,m}$, $DBj_{4,1}$ to $DBj_{4,m}$, . . . , and $DBj_{n-1,1}$ to $DBj_{n-1,m}$ into the pixel data pulses $DP_{2,1}$ to $DP_{2,m}$, $DP_{4,1}$ to $DP_{4,m}$, . . . , and $DP_{n-1,1}$ to $DP_{n-1,m}$, and applies the pixel data pulses to the column electrodes $D_1$ to $D_m$ for each of the display lines. Then, the light extinction address discharge is caused between the column electrode D and the bus electrode Yb in the control discharge cell C2 of the pixel cell PC to which the scanning pulse SP and the high-voltage pixel data pulse DP are both applied. Accordingly, the wall charge is eliminated in the control discharge cell C2. On the other hand, the light extinction address discharge is not caused in the control discharge cell C2 of the pixel cell PC to which the scanning pulse SP is applied and the high-voltage pixel data pulse DP is not applied. Accordingly, presence/non-presence of the wall charge in such control discharge cell C2 is maintained. In order to prevent erroneous discharge from occurring between the bus electrodes Xb of the odd row electrodes $X_3$, $X_5$, . . . , and $X_n$ and the column electrodes D, the odd X electrode driver 51 supplies a voltage having the same polarity as the pixel data pulse DP to each of the odd row electrodes X.

As described above, in the even row addressing stage $WI_{EV}$, the light extinction address discharge is selectively generated in the control discharge cells C2 of the pixel cells PC on the even display lines of the PDP 50, in accordance with the pixel drive data bit group DBj (j'th bits of the pixel drive data GD of the subfield SFj). As a result, the wall charge in these (selected) control discharge cells C2 is eliminated. Thus, the pixel cells PC belonging to the even display lines are set to either the provisional light emission condition (wall charge presents in the control discharge cell C2) or the light extinct condition (no wall charge presents in the control discharge cell C2).

Figure 14A:
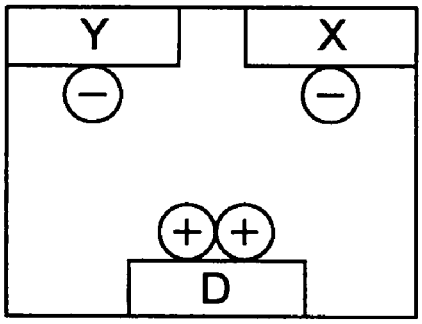
FIG. 14A schematically illustrates how electric charge is formed when elimination discharge occurs appropriately.
Figure 14B:
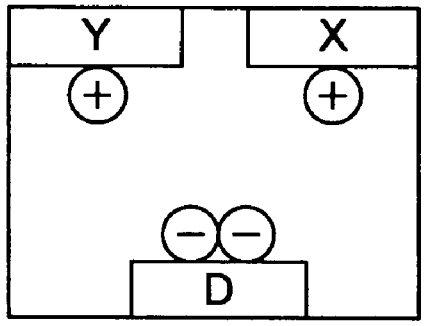
FIG. 14B schematically illustrates how electric charge is formed when elimination discharge does not occur appropriately.

In the selective light extinction assisting stage CA of the subfield SFj (SF2 to SF15), the odd X electrode driver 51, even X electrode driver 52, odd Y electrode driver 53 and even Y electrode driver 54 supply cancellation pulses CP having the positive polarity (FIGS. 12 and 13) to the row electrodes $X_2$ to $X_n$ and $Y_1$ to $Y_n$ of the PDP 50 simultaneously. As a result of application of the cancellation pulses CP, the light extinction discharge occurs in only those control discharge cells C2 in which the light extinction address discharge does not take place in a desired manner during the odd row addressing stage $WI_{OD}$ or the even row addressing state $WI_{EV}$. Thus, the wall charge is completely eliminated. If the light extinction address discharge occurs properly during the odd row addressing stage $WI_{OD}$ or the even row addressing state $WI_{EV}$, negative charge is created in the vicinity of the row electrodes X and Y within the control discharge cell C2 as shown in FIG. 14A. In this condition, discharge does not occur in this cell even if a positive voltage is applied to the row electrode X or Y. Thus, this discharge cell is in the light extinct condition. However, if the light extinction address discharge does not occur properly in the odd row addressing stage $WI_{OD}$ or the even row addressing state $WI_{EV}$, positive charge can be created in the vicinity of the row electrodes X and Y within the control discharge cell C2 as shown in FIG. 14B. In this condition, the discharge occurs in this cell when a positive voltage is applied to the row electrode X or Y. In other words, the odd row addressing stage $WI_{OD}$ and the even row addressing stage $WI_{EV}$ are designed to set the discharge cell into the light extinct state, but in reality some discharge cells may accidentally be set into the provisional light emission state. To deal with such accident, the cancellation pulses CP having the positive polarity are applied to both of the row electrodes X and Y during the selective light extinction assisting stage CA, so that the light extinction discharge is caused in only those discharge cells C2 which are in the inappropriately charged condition as shown in FIG. 14B. As a result, those discharge cells can have the appropriately charged condition as shown in FIG. 14A.

As described above, the selective light extinction assisting stage CA forces the light extinction discharge to occur in those control discharge cells C2 which are not properly set to the light extinction condition during the odd row addressing stage $WI_{OD}$ and the even row addressing stage $WI_{EV}$, so that those discharge cells C2 are brought into the light extinction condition.

In the priming expansion stage PI of the subfield SFj (SF2 to SF15), the even X electrode driver 52 intermittently generates priming pulses $PP_{XE}$ having a positive polarity, as shown in FIG. 12 or 13, and supplies the priming pulses to the even row electrodes $X_2$, $X_4$, . . . , and $X_n l_1$ of the PDP 50. Also, the even Y electrode driver 54 intermittently generates priming pulses $PP_{YE}$ having a positive polarity at the same timing as the priming pulses $PP_{XE}$, and supplies the priming pulses to the even row electrodes $Y_2$, $Y_4$, . . . , $Y_{n-2}$ and $Y_n$ of the PDP 50. In the priming expansion stage PI, the odd Y electrode driver 53 intermittently generates priming pulses $PP_{YO}$ having a positive polarity, and supplies the priming pulses to the odd row electrodes $Y_1$, $Y_3$, . . . , and $Y_n$ of the PDP 50. The odd X electrode driver 51 also intermittently generates priming pulses $PP_{XO}$ having a positive voltage value at the same timing as the priming pulses $PP_{YO}$, and supplies the priming pulses to the odd row electrodes $X_3$, $X_5$, . . . , and $X_n$ of the PDP 50. As understood from FIGS. 12 and 13, the application timing of the priming pulses $PP_{XO}$ and $PP_{YO}$ to the odd row electrodes X and Y is different from the application timing of the priming pulses $PP_{XE}$ and $PP_{YE}$ to the even row electrodes X and Y. Every time the priming pulse $PP_{XO}$, $PP_{XE}$, $PP_{YO}$ or $PP_{YE}$ is applied, the priming discharge is triggered between the row electrodes X and Y within the control discharge cell C2 of the pixel cell PC in the provisional light emission condition. When the priming discharge occurs, the discharge expands to the mating display discharge cell C1 through the clearance r (FIG. 6) so that the wall charge is formed in the display discharge cell C1.

As described above, in the priming discharge expansion stage PI, the priming discharge is repeatedly generated in the control discharge cells C2 of the pixel cells PC which are set to the provisional light emission condition during the odd row addressing stage $WI_{OD}$ or the even row address stage $WI_{EV}$. As a consequence, the discharge gradually propagates into the display discharge cells C1 if the display discharge cells C1 are associated with those control discharge cells C2. Due to the expansion of the discharge, the wall charge is created in these display discharge cells C1, and the pixel cells PC having such display discharge cells C1 are set to the light emission condition. On the other hand, the priming discharge does not occur in other control discharge cells C2 so that the wall charge is not formed in those display discharge cells C1 which communicate with these control discharge cells C2. Therefore, the pixel cells PC having such display discharge cells C1 maintain the light extinct condition.

Next, the light emission sustaining stage I is executed in the subfield SFj (SF2 to SF15). In the light emission sustaining stage I, the odd Y electrode driver 53 produces a sustaining pulse $IP_{YO}$ of a positive polarity (FIG. 12 or 13) for the number of times assigned to the subfield SFj having the sustaining stage I concerned, and supplies the sustaining pulse to the odd row electrodes $Y_1$, $Y_3$, $Y_5$, . . . , and $Y_n$. The even X electrode driver 52 produces a sustaining pulse $IP_{XE}$ of a positive polarity for the number of times assigned to the subfield SFj having the sustaining stage I concerned, at the same timing as the sustaining pulse $IP_{YO}$, and supplies the sustaining pulse to the even row electrodes $X_2$, $x_4$, . . . , and $X_{n-1}$. In the light emission sustaining stage I, the odd X electrode driver 51 produces a sustaining pulse $IP_{XO}$ of a positive polarity (FIG. 12 or 13) for the number of times assigned to the subfield SFj having the sustaining stage I concerned, and supplies the sustaining pulse to the odd row electrodes $X_1$, $X_3$, $X_5$, . . . , and $X_n$. Also in the light emission sustaining stage I, the even Y electrode driver 54 produces a sustaining pulse $IP_{YE}$ of a positive polarity for the number of times assigned to the subfield SFj having the sustaining stage I concerned, and supplies the sustaining pulse to the even row electrodes $Y_2$, $Y_4$, . . . , and $Y_{n-1}$. As understood from FIGS. 12 and 13, the application timing of the light emission sustaining pulses $IP_{XE}$ and $IP_{YO}$ is different from the application timing of the light emission sustaining pulses $IP_{XO}$ and $IP_{YE}$. Every time the sustaining pulse $IP_{XO}$, $IP_{XE}$, $IP_{YO}$ or $IP_{YE}$ is applied, the light emission sustaining discharge is generated between the transparent electrodes Xa and Ya within the display discharge cell C1 of each of the pixel cells PC which are set into the light emission condition. An ultraviolet ray produced upon the light emission sustaining discharge energizes the fluorescent layer 16 (red fluorescent layer, green fluorescent layer, or blue fluorescent layer) formed in the display discharge cell C1 (FIG. 6) so that light having the color of the fluorescent layer concerned is emitted through the front glass substrate 10. Accordingly, light emission caused by the sustaining discharge is repeated for the number of times allocated to the subfield SFj having the sustaining stage I concerned.

As described above, in the light emission sustaining stage I, only those pixel cells PC which are set to the light emission condition emit light repeatedly, for the number of times allocated to the subfield concerned.

Next, the charge movement stage MR is executed in the subfield SFj (SF2 to SF15). In the charge movement stage MR, the even X electrode driver 52 produces a charge movement pulse $MP_{XE}$ of a positive polarity (FIG. 12 or 13), and supplies the charge movement pulse to the even row electrodes $X_2$, $X_4$, . . . , and $X_{n-1}$. The even Y electrode driver 54 produces a charge movement pulse $MP_{YE}$ of a positive polarity at the same timing as the charge movement pulse $MP_{XE}$, and supplies the charge movement pulse $MP_{YE}$ to the even row electrodes $Y_2$, $Y_4$, . . . , and $Y_{n-1}$. Upon application of the charge movement pulses $MP_{XE}$ and $MP_{YE}$, discharge is triggered in the control discharge cell C2 of each of those pixel cells PC in which the light emission sustaining discharge has occurred in the immediately preceding sustaining stage I. In the charge movement stage MR, the odd Y electrode driver 53 also supplies the charge movement pulse $MP_{YO}$ having the positive polarity to the odd row electrodes $Y_1$, $Y_3$, . . . , and $Y_n$ immediately after the charge movement pulses $MP_{XE}$ and $MP_{YE}$ are applied. The odd X electrode driver 51 produces a charge movement pulse $MP_{XO}$ of a positive polarity at the same timing as the charge movement pulse $MP_{YO}$, and supplies the charge movement pulse $MP_{XO}$ to the odd row electrodes $X_3$, $X_5$, . . . , and $X_n$. Upon application of the charge movement pulses $MP_{XO}$ and $MP_{YO}$, the discharge is triggered again in the control discharge cell C2 of each of the pixel cells PC in which the light emission sustaining discharge has occurred in the preceding sustaining stage I. As a result, the wall charge in the display discharge cell C1, which is associated with such control discharge cell C2, moves into the control discharge cell C2 through the clearance r (FIG. 6).

As described above, the charge movement stage MR causes the discharge in the control discharge cells C2 of those pixel cells in which the light emission sustaining discharge occurs in the preceding light emission sustaining stage I, so that the wall charge formed in the display discharge cells C1 of such pixel cells PC is transferred to the associated control discharge cells C2.

The elimination stage E occurs in the last subfield SF15. In the elimination stage E, the odd X electrode driver 51, even X electrode driver 52, odd Y electrode driver 53, even Y electrode driver 54 and address driver 55 apply an elimination pulse of a positive polarity to all the row electrodes X and Y (not shown). As a result of the application of the elimination pulse, the elimination discharge occurs in all of those control discharge cells C2 which still have the wall charge, so that-the wall charge is eliminated.

As described above, the elimination stage E causes the elimination discharge in only those control discharge cells C2 in which the wall charge remains, thereby initializing all the control discharge cells C2 to the same condition in terms of presence of charge.

According to the drive scheme shown in FIGS. 9 to 13, the pixel cells PC can be shifted from the light extinct condition to the light emission condition in only certain periods in the subfields SF1 to SF15. Specifically, the odd row addressing stage $WO_{OD}$ and even row addressing stage $WO_{EV}$ of the subfield SF1 can only shift the pixel cells PC from the light extinct condition to the light emission condition. Therefore, when the elimination address discharge takes place in one of the subfields SF1 to SF15 to bring the pixel cell PC into the light extinct condition, this pixel cell PC will not return to the light emission condition in the following subfields. Thus, if the gradation drive is performed using the pixel drive data GD of the sixteen types as shown in FIG. 9, the write address discharge (double circle in the drawing) always occurs in the odd row addressing stage $WO_{OD}$ or the even row addressing stage $WO_{EV}$of the first subfield SF1, except the first gradation drive which represents the lowest luminance 0, so that the pixel cell PC is set to the light emission condition. The light emission condition is maintained over a certain number of subfields, which corresponds to desired luminance. Thus, the light emission by the sustaining discharge, as indicated by the white circle in FIG. 9, continues until the elimination address discharge (light extinction address discharge), as indicated by the black circle in FIG. 9, takes place. In each subfield, the light emission by the sustaining discharge occurs in the sustaining stage I.

Consequently, the luminance which corresponds to the total number of discharging occurred in one field is perceived by a viewer. When the sixteen patterns of light emission are created by the first to sixteenth gradation driving shown in FIG. 9, sixteen gradation levels (grayscale images) can be presented (perceived) in accordance with the total of discharging in one field (i.e., the sum of double circle and white circle(s) continuing in the horizontal direction of the diagram).

Each of the subfields SF1 to SF15 is assigned luminance, which is determined by the weight of the subfield. In the illustrated embodiment, the subfield SF1 is assigned the lowest luminance, and the subfield SF15 is assigned the highest luminance. In each of the subfields SF2 to SF15, the number of discharge-light-emission by the sustaining discharge during the sustaining stage I determines the luminance of the subfield. However, the subfield SF1 does not have the sustaining stage I. In the subfield SF1, the light leaking from the control discharge cell C2 to the display discharge cell C1 upon the discharging caused in the odd row addressing stage $WO_{OD}$, the even row addressing stage $WO_{EV}$, and the priming stage P is used to create the light of lowest luminance. In FIG. 9, the second gradation driving creates the higher (brighter) luminance than the luminance of the first gradation driving. The luminance of the second gradation is higher than the lowest gradation (first gradation) by one step. In the second gradation driving, the light emission by the sustaining discharge does not occur in the sustaining stage I in any of the subfields SF2 to SF15. This means that the light leaking to the display discharge cell C1 from to the control discharge cell C2 upon the address discharge caused in the odd row addressing stage $WO_{OD}$ or the even row addressing stage $WO_{EV}$ of the subfield SF1, and/or the priming discharge caused in the priming stage P is only used to create the luminance of the second gradation level.

The leakage light to the display discharge cell C1 from the control discharge cell C2 has lower luminance than the light emission by the sustaining discharge. Therefore, the second gradation can reduce (moderate) the luminance difference between the first gradation and the third gradation. The first gradation is the lowest luminance (black), and the third gradation is brighter than the first gradation by two steps.

Thus, gradation can be expressed smoothly even if the image has low luminance. In other words, low luminance image reproduction of high quality can be achieved.

According to the above described drive scheme, neither the write address discharge nor the elimination address discharge occurs over the subfields SF1 to SF15, when the first gradation driving is performed to create the lowest luminance 0, as understood from FIG. 9. When the image having the least bright luminance 0 is expressed by the first gradation driving, the write address discharge and the elimination address discharge do not take place (therefore, no light emission would result from the discharge) so that the contrast in a dark image is improved.

In the PDP apparatus 49 shown in FIG. 4, the pixels are defined by the pixel cells PC, and each pixel cell PC is defined by the display discharge cell C1 and the control discharge cell C2 (FIGS. 5 and 6). The light emission sustaining discharge, which contributes to the displaying of the image, occurs in the display discharge cell C1, whereas the reset discharge, priming discharge and address discharge which emit light but do not contribute to the displaying of the image, occur in the control discharge cell C2. The control discharge cell C2 has the protruding dielectric layer (or the light-absorbing layer) 12, which includes a black or dark colorant, to prevent the light produced upon various discharges occurring in the control discharge cell C2 from leaking to the outside through the front glass substrate 10.

Since the light emission resulting from the reset discharge, priming discharge and address discharge is blocked by the protruding dielectric layer 12, the contrast of the displayed image is enhanced. Particularly, the contrast of a dark image is sharpened.

The control discharge cell C2 has the secondary electron emission layer 30 on the back substrate 13, as shown in FIG. 6. Because of the secondary electron emission layer 30, the discharge starting voltage between the column electrode D and row electrode Y within the control discharge cell C2 and the discharge maintaining voltage are lower than the discharge starting voltage between the column electrode D and row electrode Y within the display discharge cell C1 and the discharge maintaining voltage. In short, the display discharge cell C1 requires the higher discharge initiation voltage and higher discharge maintaining voltage than the control discharge cell C2. Therefore, even if the priming expansion stage PI is executed to cause the discharge to expand to the display discharge cell C1 by repeating the priming discharge within the control discharge cell C2, only weak discharge occurs within the display discharge cell C1. This suppresses the deterioration of the contrast in the dark image. The priming discharge occurs in the discharge gap g' between the transparent electrodes Xa and Ya within the control discharge cell C2. Since the discharge gap g' is closer to the display discharge cell C1 within the control discharge cell C2 (closer than the center of the bus electrodes Xb and Yb), the expansion of the discharge to the display discharge cell C1 is ensured.

During the driving shown in FIGS. 11 to 13, the reset discharge and address discharge occur between the row electrode Y and column electrode D within each control discharge cell C2. The distance between the row electrode Y and display discharge cell C1 is greater than the distance between the row electrode X and display discharge cell C1. Therefore, the ultraviolet ray created by the reset discharge and address discharge does not leak very much to the display discharge cell C1. This prevents the deterioration of the contrast in the dark image.

In the illustrated and described embodiment, the row electrodes are arranged in the order of Y, X, Y, X, . . . in the PDP 50. The scanning pulse is applied to the row electrode Y. In each control discharge cell C2 (second discharge cell), the row electrode Y is further from the display discharge cell C1 (first discharge cell) than the row electrode X. A unit area of light emission (light emission element) is defined by the first and second discharge cells in the PDP 50. When viewed in the column electrode direction (vertical direction of the PDP), therefore, the discharge cells are arranged in the order of second discharge, first discharge cell, second discharge cell, first discharge cell, . . . . Each pair of second discharge cell and first discharge cell defines the unit light emission area or the light emission element. Thus, it can be said that the PDP 50 has a "second discharge cell-first discharge cell" cell structure.

Various modifications and changes may be made to the illustrated and described embodiment by those skilled in the art without departing from the spirit and scope of the present invention. For example, the present invention can be applied to the PDP which does not have the above described cell structure. Specifically, the scanning pulse may be applied to the row electrode Y and located closer to the display discharge cell (first discharge cell) C1 than the row electrode X within the control discharge cell (second discharge cell) C2. In other words, the row electrodes may be arranged in the order of X, Y, X, Y, . . . . When viewed in the column electrode direction, the discharge cells may be arranged in the order of first discharge cell, second discharge cell, first discharge cell, second discharge cell, . . . . In this arrangement, the row electrode X faces the mating row electrode Y over the first discharge gap in the first discharge cell, and the row electrode Y faces another row electrode X of an adjacent row electrode pair over the second discharge gap in the second discharge cell.

It should also be noted that the reset discharge may occur between the row electrode Y and column electrode in the second discharge cell, or between the row electrode Y and a row electrode X of an adjacent row electrode pair. Also, the priming discharge may be not be performed after the address discharge.

It is also permissible to arrange the row electrodes in the order of X, Y, Y, X, . . . . In this arrangement, two second discharge cells are adjacent to each other if two continuous unit light emission areas are considered in the column electrode direction. In summary, the present invention can be applied to the PDP which has any of the following cell structures when the first discharge cell and the mating second discharge cell are considered in the column electrode direction; the "first discharge cell-second discharge cell" structure, the "second discharge cell-first discharge cell" structure, and the "first discharge cell-second discharge cell and the second discharge cell-first discharge cell" structure. In such PDP, the reset discharge and address discharge are caused between the row electrode Y and column electrode within the second discharge cell, and the priming discharge is dispensed with. Unit light emission areas are arranged successively in the row and column directions, and the discharge space in the second discharge cell of each unit light emission area is closed relative to the second discharge cells of the neighboring unit light emission areas by the horizontal and vertical walls.

This application is based on a Japanese patent application No. 2002-295328, and the entire disclosure thereof is incorporated herein by reference.

What is claimed is:

1. A method of driving a display panel to display a multi-gradation-level image based on an input image signal by driving the display panel for each of a plurality of subfields, the plurality of subfields defining one field of the input image signal, the display panel including a front substrate and a back substrate which face each other across a discharge space, a plurality of row electrode pairs arranged on an inner surface of the front substrate such that one row electrode pair extends adjacent to another row electrode pair, each row electrode having a first portion and a second portion, a plurality of column electrodes arranged on an inner surface of the back substrate such that the plurality of column electrodes extend perpendicularly to the plurality of row electrode pairs and define a plurality of crossing portions of the column electrodes and row electrode pairs, and a plurality of light emission elements formed at the plurality of crossing portions of the column electrodes and row electrode pairs, each of the plurality of light emission elements being defined by a first discharge cell and a second discharge cell, the first discharge cell having the first portion of one row electrode and the first portion of a mating row electrode in one row electrode pair such that these two first portions face each other across a first discharge gap in the discharge space, the second discharge cell having the second portion of one electrode in the row electrode pair belonging to the mating first discharge cell, and the second portion of one electrode belonging to an adjacent row electrode pair such that these two second portions face each other across a second discharge gap in the discharge space, the second discharge cell also having a light-absorbing layer formed on the front substrate side, wherein each subfield includes an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition in which wall charge exists in the second discharge cell, or a light extinction condition in which the wall charge does not exist in the second discharge cell, and wherein leakage light leaking to the first discharge cell from the mating second discharge cell upon the address discharge is used to express a low-luminance gradation.

2. The method of driving a display panel according to claim 1, wherein each subfield further includes a priming stage for only causing priming discharge to occur in the second discharge cell which is set to the light emission condition, so as to move the wall charge to the first discharge cell from the second discharge cell of the light emission condition, and to set the first discharge cell into the light emission condition.

3. The method of driving a display panel according to claim 1, wherein each subfield has a weight, and the low-luminance gradation is created by the leakage light in only those subfields which have a small weight compared to others of the subfields.

4. The method of driving a display panel according to claim 3, wherein each of those subfields which do not have the small weight includes a light emission sustaining stage for applying a sustaining pulse to each row electrode pair to trigger light-emission-sustaining discharge in only the first discharge cells which are set to the light emission condition, for a number of times corresponding to the weight of the subfield concerned.

5. The method of driving a display panel according to claim 3, wherein the address stage of the subfield having the small weight includes a write address stage for selectively triggering write-discharge in the second discharge cell based on the input image signal to set the second discharge cell into the light emission condition, and the address stage of a subfield following the subfield having the small weight includes an elimination address stage for selectively triggering elimination-discharge in the second discharge cell based on the input image signal to set the second discharge cell into the light extinction condition.

6. The method of driving a display panel according to claim 1, wherein the second discharge gap in the second discharge cell is located closer to the mating first discharge cell than a center between two row electrodes belonging to the second discharge cell.

7. The method of driving a display panel according to claim 1, wherein each of two row electrodes in each row electrode pair has a main portion extending in a horizontal direction of the display panel and a projecting portion extending from the main portion at right angles such that the main portions and projecting portions of the two row electrodes in the row electrode pair belong to the same light emission element, the projecting portion has the second portion at its free end and the first portion at its root portion, the first discharge cell has the first portion of one row electrode and the first portion of another row electrode in one row electrode pair across the first discharge gap, and the second discharge cell has the second portion of one of the two electrodes in the row electrode pair belonging to the first discharge cell and the second portion of one of the two electrodes in the adjacent row electrode pair across the second discharge gap.

8. The method of driving a display panel according to claim 1, wherein the discharge space for one second discharge cell is sealed against the discharge space for an adjacent second discharge cell in the horizontal direction of the display panel, and the discharge space for one first discharge cell is communicated with the discharge space for an adjacent first discharge cell in the horizontal direction of the display panel.

9. The method of driving a display panel according to claim 1, wherein the first discharge cell and second discharge cell in each light emission element are separated from each other by a partition wall standing from the inner surface of the back substrate, and the discharge space of the first discharge cell is communicated with the discharge space of the second discharge cell by a clearance between the partition wall and the front substrate.

10. The method of driving a display panel according to claim 1, wherein a fluorescent layer, which emits light upon discharging, is formed in each first discharge cell.

11. The method of driving a display panel according to claim 1, wherein a secondary electron emission layer is formed in each second discharge cell on the back substrate side.

12. The method of driving a display panel according to claim 1, wherein each subfield includes a reset stage for applying a reset pulse between one electrode in each row electrode pair and the column electrodes, prior to the address discharge by the address stage, such that the column electrodes have a lower electrical potential than the corresponding row electrodes, thereby triggering reset discharge in the second discharge cell in each light emission element.

13. The method of driving a display panel according to claim 12, wherein the reset stage includes an odd reset stage for triggering the reset discharge in the second discharge cell of each odd display line and an even reset stage for triggering the reset discharge in the second discharge cell of each even display line, and the odd reset stage and the even reset stage are executed separately.

14. The method of driving a display panel according to claim 1, wherein the address stage includes an odd address stage for triggering the address discharge in the second discharge cell of each odd display line and an even address stage for triggering the address discharge in the second discharge cell of each even display line, and the odd address stage and the even address stage are executed separately.

15. The method of driving a display panel according to claim 12, wherein a waveform of the reset pulse has gentler rise and fall edges than a waveform of the light emission sustaining pulse.

16. The method of driving a display panel according to claim 1, wherein each subfield includes an elimination stage for applying an elimination pulse to each row electrode pair to trigger elimination discharge in each first discharge cell after the light emission sustaining discharge by the light emission sustaining stage is complete.

17. The method of driving a display panel according to claim 1, wherein each subfield includes a charge movement stage for applying a charge movement pulse between the row electrode belonging to each second discharge cell and one row electrode of an adjacent row electrode pair to trigger discharge in the second discharge cell only if the light emission sustaining discharge occurs in the mating first discharge cell, thereby moving the wall charge to the second discharge cell from the first discharge cell, after the light emission sustaining discharge by the light emission sustaining stage is complete.

18. A method of driving a display panel to display a multi-gradation-level image based on an input image signal by driving the display panel for each of a plurality of subfields, the plurality of subfields defining one field of the input image signal, the display panel including a front substrate and a back substrate which face each other across a discharge space, a plurality of row electrode pairs arranged on an inner surface of the front substrate, a plurality of column electrodes arranged on an inner surface of the back substrate such that the plurality of column electrodes extend perpendicularly to the plurality of row electrode pairs and define a plurality of crossing portions of the column electrodes and row electrode pairs, and a plurality of light emission elements formed at the plurality of crossing portions of the column electrodes and row electrode pairs, each of the plurality of light emission elements being defined by a first discharge cell and a second discharge cell, the second discharge cell having a light-absorbing layer formed on the front substrate side, wherein each subfield includes an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition in which wall charge exists in the second discharge cell, or a light extinction condition in which the wall charge does not exist in the second discharge cell, and wherein light leaking to the first discharge cell from the second discharge cell upon the address discharge is used to express low-luminance gradation.

19. A method of driving a display panel to display a multi-gradation-level image based on an input image signal by driving the display panel for each of a plurality of subfields, the plurality of subfields defining one field of the input image signal, the display panel including a front substrate and a back substrate which face each other across a discharge space, a plurality of row electrode pairs arranged on an inner surface of the front substrate, a plurality of column electrodes arranged on an inner surface of the back substrate such that the plurality of column electrodes extend perpendicularly to the plurality of row electrode pairs and define a plurality of crossing portions of the column electrodes and row electrode pairs, and a plurality of light emission elements formed at the plurality of crossing portions of the column electrodes and row electrode pairs, each of the plurality of light emission elements being defined by a first discharge cell and a second discharge cell, the second discharge cell having a light-absorbing layer formed on the front substrate side, wherein each subfield includes:

an address stage for applying a scanning pulse to one electrode in each of the row electrode pairs sequentially, and applying a pixel data pulse derived from the input image signal to the column electrodes at the same timing as the scanning pulse to selectively trigger address discharge within the second discharge cell of each light emission element so as to set the second discharge cell into either a light emission condition in which wall charge exists in the second discharge cell, or a light extinction condition in which the wall charge does not exist in the second discharge cell; and a priming stage for applying a priming pulse to two electrodes in each row electrode pair so as to trigger priming discharge in only those second discharge cells which are set to the light emission condition, and wherein light leaking to the first discharge cell from the second discharge cell upon at least one of the address discharge and the priming discharge is used to express low-luminance gradation.

* * * * *